US011718898B2

(12) United States Patent
Moore et al.

(10) Patent No.: US 11,718,898 B2
(45) Date of Patent: Aug. 8, 2023

(54) RARE EARTH ELEMENT—ALUMINUM ALLOYS

(71) Applicants: Lawrence Livermore National Security, LLC, Livermore, CA (US); University of Tennessee Research Foundation, Knoxville, TN (US); Iowa State University Research Foundation, Inc., Ames, IA (US); UT-Battelle, LLC, Oak Ridge, TN (US); Eck Industries, Inc., Manitowoc, WI (US)

(72) Inventors: Emily E. Moore, Livermore, CA (US); Hunter B. Henderson, Knoxville, TN (US); Aurelien Perron, Pleasanton, CA (US); Scott K. McCall, Livermore, CA (US); Orlando Rios, Knoxville, TN (US); Zachary C. Sims, Knoxville, TN (US); Michael S. Kesler, Knoxville, TN (US); David Weiss, Manitowoc, WI (US); Patrice E. A. Turchi, Menlo Park, CA (US); Ryan T. Ott, Ames, IA (US)

(73) Assignees: Lawrence Livermore National Security, LLC, Livermore, CA (US); University of Tennessee Research Foundation, Knoxvile, TN (US); Iowa State University Research Foundation, Inc., Ames, IA (US); UT-Battelle, LLC, Oak Ridge, TN (US); Eck Industries, Inc., Manitowoc, WI (US)

( * ) Notice: Subject to any disclaimer, the term of this patent is extended or adjusted under 35 U.S.C. 154(b) by 236 days.

(21) Appl. No.: 16/927,787

(22) Filed: Jul. 13, 2020

(65) Prior Publication Data

US 2021/0108292 A1 Apr. 15, 2021

Related U.S. Application Data

(60) Provisional application No. 62/873,719, filed on Jul. 12, 2019.

(51) Int. Cl.
*C22C 21/02* (2006.01)

(52) U.S. Cl.
CPC ..... *C22C 21/02* (2013.01); *Y10T 428/12181* (2015.01)

(58) Field of Classification Search
None
See application file for complete search history.

(56) References Cited

U.S. PATENT DOCUMENTS 8,758,529 B2 * 6/2014 Wang ..... C22F 1/05 148/417
8,778,099 B2 * 7/2014 Pandey ..... C22F 1/057 148/688

(Continued)

FOREIGN PATENT DOCUMENTS

EP 0508426 * 9/1998
WO 2017007908 A1 1/2017

OTHER PUBLICATIONS

Sims et al., "Cerium-Based, Intermetallic-Strengthened Aluminum Casting Alloy: High-Volume Co-product Development," JOM, vol. 68, No. 7, 2016, pp. 1940-1947.

(Continued)

*Primary Examiner* — Daniel J. Schleis
(74) *Attorney, Agent, or Firm* — Zilka-Kotab, P.C.

(57) ABSTRACT

An alloy includes aluminum, a rare earth element, and an alloying element selected from the following: Si, Cu, Mg, (Continued)

Fe, Ti, Zn, Zr, Mn, Ni, Sr, B, Ca, and a combination thereof. The aluminum (Al), the rare earth element (RE), and the alloying element are characterized by forming at least one form of an intermetallic compound. An amount of the rare earth element in the alloy is in a range of about 1 wt. % to about 12 wt. %, and an amount of the alloying element in the alloy is greater than an amount of the alloying element present in the intermetallic compound.

20 Claims, 16 Drawing Sheets

(56) References Cited

U.S. PATENT DOCUMENTS

| | | | | |
|---|---|---|---|---|
| 9,963,770 | B2 | 5/2018 | Rios et al. | |
| 2004/0055671 | A1* | 3/2004 | Olson | C22F 1/04 148/403 |
| 2006/0093512 | A1* | 5/2006 | Pandey | C22C 45/08 420/528 |
| 2006/0269437 | A1* | 11/2006 | Pandey | C22F 1/04 420/550 |
| 2018/0080103 | A1 | 3/2018 | Plotkowski et al. | |
| 2019/0085431 | A1 | 3/2019 | Rios et al. | |

OTHER PUBLICATIONS

Chu, S., "Critical Materials Strategy," U.S. Department of Energy, Dec. 2011, 196 pages.

Nguyen et al., "Anticipating impacts of introducing aluminum-cerium alloys into the United States automotive market," Resources, Conservation & Recycling, vol. 144, 2019, pp. 340-349.

Sims et al., "High performance aluminum-cerium alloys for high-temperature applications," Materials Horizons, vol. 4, 2017, pp. 1070-1078.

Redlich et al., "Algebraic representation of thermodynamic propertiesand the classification of solutions," vol. 40, pp. 345-348.

Saunders et al., "CALPHAD (Calculation of Phase Diagrams): A Comprehensive Guide," Pergamon Materials Series, Elsevier Science, 1998, 497 pages.

Anasara et al., "COST 507 Thermochemical databse for light metal alloys," COST Eurpoean Commission, vol. 2, Jul. 1998, 420 pages.

Kesler et al., "Liquid direct reactive interface printing of structural aluminum alloys," Applied Materials Today, vol. 13, 2018, pp. 339-343.

Plotkowski et al., "Evaluation of an Al—Ce alloy for laser additive manufacturing," Acta Materialia, vol. 126, 2017, pp. 507-519.

Weiss et al., "Improved High-Temperature Aluminum Alloys Containing Cerium," Journal of Materials Engineering and Performance, vol. 28, No. 4, Apr. 2019, pp. 1903-1908.

CRTC, "The SGTE(2007) alloy database," Centre for Research in Computational Thermochemistry, 2007, 45 pages, retrived from http://www.crct.polymtl.ca/fact/documentation/SGTE2007/SGTE2007_documentation.htm.

Thermo-Calc Software, "SSOL5—SGTE Solution Database, Version 5.0," Thermo-Calc Software AB, 2014, 99 pages, retrieved from https://www.thermocalc.com/media/8160/ssol5_extended_info_2014-02-04.pdf.

Chaoqui et al., "Liquidus and Intermetallic Compound in Al-Rich Region of Al—Mg—-Ce System," Acta Metallurgica Sinica, vol. 22, No. 2, 1986, 7 pages.

Statement of Relevance of Non-Translated Foreign Document: Chaoqui et al., "Liquidus and Intermetallic Compound in Al-Rich Region of Al—Mg—Ce System", 2021, 1 page.

* cited by examiner

RARE EARTH ELEMENT—ALUMINUM ALLOYS

RELATED APPLICATION

This application claims priority to U.S. Provisional Patent Application No. 62/873,719 filed Jul. 12, 2019, which is herein incorporated by reference.

This invention was made with government support under Contract No. DE-AC52-07NA27344 between the United States Department of Energy and Lawrence Livermore National Security, LLC for the operation of Lawrence Livermore National Laboratory; and under Contract No. DE-AC02-07CH11358 awarded by the U.S. Department of Energy. The United States Government has rights in this invention pursuant to contract no. DE-AC05-000R22725 between the United States Department of Energy and UT-Battelle, LLC. The government has certain rights in the invention.

FIELD OF THE INVENTION

The present invention relates to aluminum alloys with rare earth element additions; and more particularly, this invention relates to formation of optimized rare earth element-modified aluminum alloy compositions for advanced manufacturing and methods for making same.

BACKGROUND

The development of aluminum (Al) alloys to include cerium (Ce) is desirable for ameliorating the mining-economics of rare earth elements. The criticality of rare earth (RE) elements, which are essential to a variety of technologies and more specifically to clean energy applications, is detailed in a report issued by the United States Department of Energy. In addition to supply scarcity of RE elements, which also rely largely on exports from a small number of nations, additional challenges emerge from potentially unfavorable industrial economics of byproducts produced during mining. Assuring a need for the more abundant by-products such as Ce and lanthanum (La) would likely improve the economics of the more critical RE elements, such as neodymium (Nd) and dysprosium (Dy), used in wind turbines, electric vehicles, etc.

Recent efforts of incorporating Ce into Al-based alloys to produce high performance and economically attractive materials would provide a meaningful pathway to render Ce as a co-product instead of by-product of mining RE elements.

Initially, Al-based alloys having small additions of less than 5 weight % (wt. %) Ce were developed. In recent contemplated approaches, experiments have shown that alloys having up to 16 wt. % Ce for improving mechanical properties for the binary Al—Ce system is possible. The addition of conventional alloying elements (e.g., Si, Zn, Cu, Mg, Fe, etc.) is not well understood when considering Al—Ce alloys. It would be desirable to tune conventional Al-based alloys (e.g., A356, A390 and A206 alloys, Al—Mg, Al—Si and Al—Cu alloys, etc.) to include RE elements while maintaining castability and improve mechanical properties without necessarily expensive heat treatments generally applied to the precipitation hardening of intermetallics. Further, interactions between RE elements and other alloying elements complicate alloy design and change the strengthening potency of various elements. Preliminary approaches indicate that high RE/Si ratios tend to result in voids in the material and thereby result in difficult casting conditions. It would be desirable to develop a process to determine optimal alloy compositions for improving processes such as sand casting, low pressure casting, high pressure die casting, squeeze casting, direct metal write, direct chill casting, rheocasting, additive manufacturing, advanced manufacturing, etc. Moreover, it would desirable to develop aluminum-rare earth alloys with improved strengthening potency.

SUMMARY

According to one embodiment, an alloy includes aluminum, a rare earth element, and an alloying element selected from the following: Si, Cu, Mg, Fe, Ti, Zn, Zr, Mn, Ni, Sr, B, Ca, and a combination thereof. The aluminum (Al), the rare earth element (RE), and the alloying element are characterized by forming at least one form of an intermetallic compound. An amount of the rare earth element in the alloy is in a range of about 1 wt. % to about 12 wt. %, and an amount of the alloying element in the alloy is greater than an amount of the alloying element present in the intermetallic compound.

According to another embodiment, methods include a computational and experimental feedback loop in which constituent alloying effects (such as precipitation hardening) are retained by applying empirical relationships to saturate RE content and optimized freezing ranges are tailored for casting and advanced manufacturing purposes.

Other aspects and implementations of the presently described inventive concepts will become apparent from the following detailed description, which, when taken in conjunction with the drawings, illustrate by way of example the principles of the invention.

DETAILED DESCRIPTION

Figure 1:
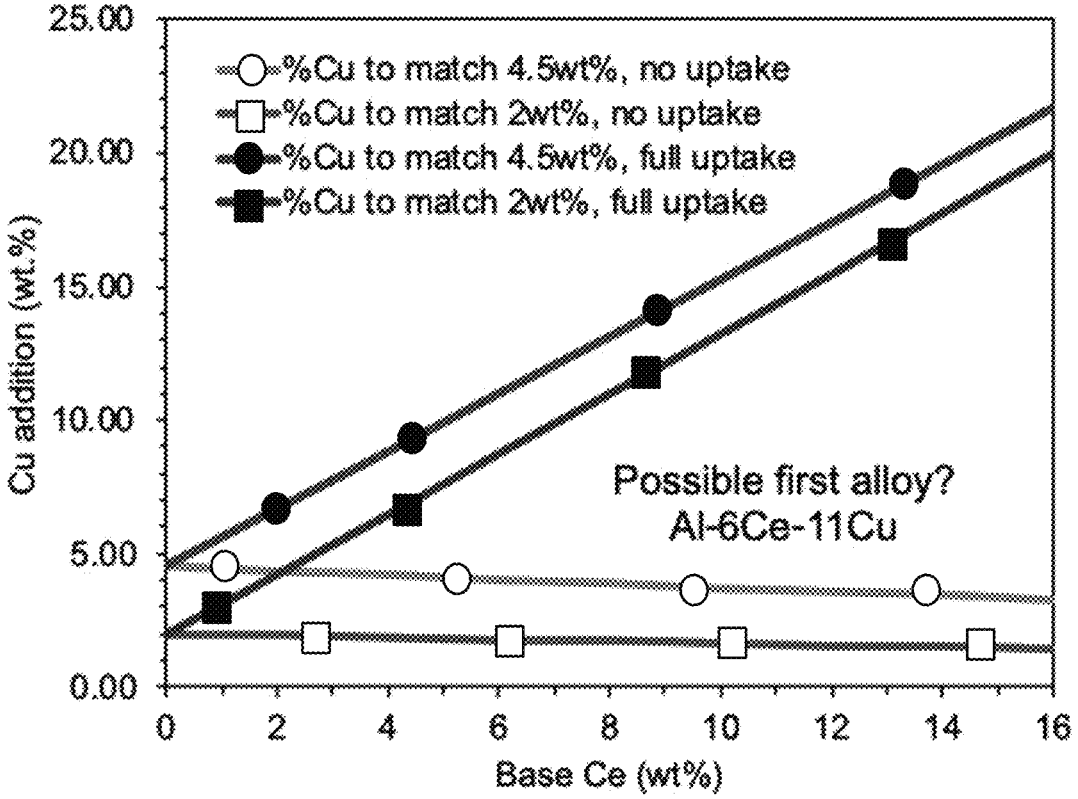
FIG. 1 depicts a plot of the addition of Cu (constituent alloy) to reach standard alloying levels (2 wt. % and 4.5 wt. %) in the matrix after saturating the Ce phases, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

Further, as used herein, percentage values are to be understood as percentage by weight (wt. %), percentage by volume (vol. %), or atomic percent (at. %), unless otherwise noted. Percentages by weight are to be understood as disclosed in an amount relative to the bulk weight of the material being described in association therewith, in various approaches. Percentages by volume are to be understood as disclosed in a volume relative to the total volume of the material being described in association therewith, in various approaches. Atomic percent (at. %) is to be understood as a percentage of one kind of atom relative to the total number of atoms in a compound, in various embodiments.

Unless expressly defined otherwise herein, each component listed in a particular approach may be present in an effective amount. An effective amount of a component means that enough of the component is present to result in a discernable change in a target characteristic of the final product in which the component is present, and preferably results in a change of the characteristic to within a desired range. One skilled in the art, now armed with the teachings herein, would be able to readily determine an effective amount of a particular component without having to resort to undue experimentation.

As also used herein, the term "about" denotes an interval of accuracy that ensures the technical effect of the feature in question. In various approaches, the to "about" when combined with a value, refers to plus and minus 10% of the reference value. For example, a thickness of about 10 nm refers to a thickness of 10 nm±1 nm, a temperature of about 50° C. refers to a temperature of 50° C.±5° C., etc.

For the purposes of this application, room temperature is defined as in a range of about 20° C. to about 25° C.

For purposes of this application, alloys are generally abbreviated to include the wt. % of each component relative to total alloy composition, e.g., Al-10 wt. % Mg-8 wt. % Ce alloy may be abbreviated to Al-10Mg-8Ce. For intermetallic compounds, phases, particles, etc. a general composition of an intermetallic phase having Al, Ce, and Cu may be represented by Al—Ce—Cu, and a specific intermetallic phase and/or associated crystal structure of this group may be represented by $AlCe_2Cu_2$. These examples provide explanations of abbreviations and terminology and are not meant to be limiting in any way.

The description herein is presented to enable any person skilled in the art to make and use the invention and is provided in the context of particular applications of the invention and their requirements. Various modifications to the disclosed embodiments will be readily apparent to those skilled in the art upon reading the present disclosure, including combining features from various embodiment to create additional and/or alternative embodiments thereof.

Moreover, the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

The following description discloses several preferred inventive concepts of optimized rare earth element-modified aluminum alloy compositions and/or related systems and methods.

In one general embodiment, an alloy includes aluminum, a rare earth element, and an alloying element selected from the following: Si, Cu, Mg, Fe, Ti, Zn, Zr, Mn, Ni, Sr, B, Ca, and a combination thereof. The aluminum (Al), the rare earth element (RE), and the alloying element are characterized by forming at least one form of an intermetallic compound. An amount of the rare earth element in the alloy is in a range of about 1 wt. % to about 12 wt. %, and an amount of the alloying element in the alloy is greater than an amount of the alloying element present in the intermetallic compound.

A list of abbreviations and acronyms used in the description is provided below.

3D three-dimensional
Al aluminum
at. % atomic percent
B boron
BCC body centered cubic
BSE backscatter electron
° C. degrees Celsius
Ca calcium
CALPHAD CALculation of PHAse Diagrams
Ce cerium
Cu copper
DHCP double hexagonal close packed
DTA Differential thermal analysis
Dy dysprosium
FCC face centered cubic
Fe iron
HCP hexagonal close packed
K kelvin
La lanthanum
Mg magnesium
Mm mischmetal
Mn manganese
MPa megapascal
Nd neodymium
Ni nickel
Pa pascal
Pr praseodymium
PSI pounds per square inch
RE rare earth
SEM scanning electron microscope
Si silicon
Sr strontium
TEM transmission electron microscope
Ti titanium
UTS ultimate tensile strength
vol. % volume percent
wt. % weight percent
Zn zinc
Zr zirconium Al-based alloys are in wide-use throughout the transportation industry where strength-to-weight ratio is crucial, ranging in application from automotive to aerospace. An alloy includes a combination of metals or metals combined with one or more other elements. The alloy may contain intermetallic phase(s) of more than one metallic element, and a solution phase that acts as the matrix phase and/or free elements in solution. Moreover, the solution phase may be a solid solution phase in which alloying elements exist as solutes in the matrix for solutionizing purposes. The intermetallic phase may be an ordered structure that has a specific composition of two or more different elements. Another type of phase may be a solid solution, for example a face-centered cubic (FCC) structure that allows for different soluble atoms but remains in the FCC phase. Typically, intermetallic phases of an alloy include intermetallic compounds which are solid-state structures formed from two or more metals in the alloy that exhibit a defined stoichiometry, stoichiometric range, etc. and a crystal structure. Intermetallic compounds may include two metals (binary), three metals (ternary), four metals (quaternary), etc.

The matrix phase may incorporate a certain degree of free elements in the solid solution structure and surrounds any intermetallic phases. For example, an Al-based matrix may include a random mixing of alloying elements in the FCC crystal structure of the Al-based matrix. In an alloy, the intermetallic compound has a crystal structure that is structurally distinct from the matrix phase. An intermetallic particle may be any phase that is not soluble in the matrix phase, thus an intermetallic particle may be a binary, ternary, etc. intermetallic phase. Typically, an intermetallic particles refers to a small localized object within the alloy, for example, intermetallic particles of varying size may exist throughout an Al-based (FCC)-matrix.

An alloy may include alloying elements. Typical alloying elements (or impurities) include: Mg, Si, Cu, Ni, Zn, Zr, Mn, Fe, etc. which depending on composition and abundance may increase the strength and hardness of the alloy by precipitation hardening and/or solid solution strengthening. However, high temperature performance is a limiting factor for many of the conventional Al-based alloys because of rapid microstructural coarsening above a temperature of 150° C., along with other factors.

In various approaches, the family of Al-RE alloys (up to 16 wt. %) demonstrates promising mechanical properties at elevated temperatures in addition to improved castability and thermal stability as compared to conventional Al-based alloys. RE elements of Al-RE-based alloys may include Ce, La, Mischmetal (an alloy of RE elements), Nd, Pr, etc. A supplemental benefit, and likely economically attractive benefit, inherent in the Al-RE alloys may include the intermetallic strengthening component may not involve a post-casting heat treatment. Additionally, the insoluble intermetallic particles that form during solidification are extremely resistant to coarsening and pin grain boundaries at high temperature.

Moreover, some preliminary investigations indicate a particular ratio of RE/Cu, RE/Mg or RE/X is necessary to saturate the RE content and have available alloying element X available for strengthening. According to embodiments described herein, various compositions have been formulated that respond to solution strengthening, precipitation hardening heat treatments, etc. appropriate for aluminum-rare earth element alloys, for example, and not meant to be limiting, Al—Ce alloys.

Tailoring Al-RE based alloys to meet industrial design standards may include many robust and costly experiments on the laboratory scale. Even so, computational efforts may be used to complement experimental findings and allow for the exploration of a larger composition space than otherwise possible. A multicomponent thermodynamic database has been developed using the CALPHAD (CALculation of PHAse Diagrams) method to address the phase behavior of Al—Ce based alloys, including all the binary and some ternary interactions from the Al, Ce, Cu, Fe, La, Mg, Ni, Si, Zn, Zr, etc. range of elements, which is applied to the formation of RE-modified Al-based alloys.

In one embodiment, an alloy includes aluminum (Al), a rare earth (RE) element, and an alloying element selected from one of the following: Si, Cu, Mg, Fe, Ti, Zn, Zr, Mn, Ni, Sr, B, Ca, or a combination thereof. The Al, the RE element, and the alloying element are characterized by forming at least one form of an intermetallic compound (e.g., Al-RE-alloying element). An amount of the RE element in the alloy may be in a range of about 1 wt. % to about 12 wt. %. An amount of the alloying element in the alloy may be greater than an amount of the alloying element present in the intermetallic compound.

In a preferred approach, the alloy includes an Al-based matrix where the alloying element may be present in the Al-based matrix. For example, in one approach, the alloying element may be solutionized in the Al-based matrix. The alloying element may be present in the Al-based matrix after a standard solutionizing heat treatment and quench process of the alloy. In another approach, the alloying element may be substituted in a position on the FCC structure of the Al-based matrix. In one approach, the alloying element may be present in elemental form surrounded by Al-based matrix.

In some approaches, the alloy may include one of the following rare earth (RE) elements: cerium (Ce), lanthanum (La), neodymium (Nd), Praseodymium (Pr), Mischmetal (Mm), etc. Mm is defined as an alloy RE elements that includes a combination of two or more of the elements Ce, La, Nd, and Pr. A typical composition of Mm includes mainly Ce/La at 55 wt %/25 wt. % with some smaller amounts of other RE elements. In preferred approaches, Mm includes mainly Ce and La with smaller amounts of other RE elements.

In one embodiment, a material (e.g., a composite material) may include an alloy composition described herein in combination with an additional material. The additional material may include more than one component. In one approach, the additional material has a non-metallic form. In various approaches the additional material has a different composition than the alloy composition. The additional material preferably has significantly different physical and/or chemical properties that, when combined with the alloy composition, produce a material with characteristics different from the individual components. In one approach, the additional material may strengthen the alloy composition in the material. According to one approach, alloy compositions as described herein in combination with one or more additional components may form a material having physical characteristics different from the individual components of the material.

A typical framework for a composite material includes a matrix (e.g., an alloy, metal matrix composite, etc.) and a reinforcement material (e.g., an additional material). Exemplary examples of reinforcement material may include carbon fibers, silicon carbide particles, borides, aluminum oxide nanoparticles, etc. The range of amount, loading fraction, volume fraction, etc. of reinforcement material in a composite material may vary depending on the type of reinforcement material, alloy, and/or the resulting composite material. For a nanoparticle reinforcement material, an appropriate loading fraction may be in a range of 0.1 to 2 vol. % of total vol. % of composite material. For a carbon fiber reinforcement material, an appropriate loading fraction may be in a range of up to 50% vol. % reinforcement of total vol. % of composite material.

In various approaches, the amount of metallic alloy in a composite material may be in a range of about 50 vol. % to about 100 wt. % of the total vol. % of the material, with the remainder as additional material, e.g., fiber, particulate reinforcement of some other material with minimum dimension at most 300 micrometers, etc. In one approach, the amount of the alloy may be in a range of about 90 vol. % to about 99.5 vol. % of the total vol. % of the composite material. In one approach, the amount of alloy may be in a range of about 97 vol. % to about 99 vol. % of the total vol. % of the composite material. The remaining vol. % of the composite material is the vol. % fraction of additional material, e.g., reinforcement material.

In one approach, an alloy includes an amount of aluminum (Al) that is a balance of the total amount of the RE element and the alloying element(s). For example, an alloy includes aluminum in balance with up to a total amount of 5 wt. % cerium (Ce) in a combination with at least one of the following alloying elements: Si, Cu, Mg, Fe, Ti, Zn, Zr, Mn, Ni, Sr, B, Ca, or a combination thereof.

In another example, an alloy includes an amount of aluminum in balance with up to a total amount of 5 wt. % mischmetal (Mm) in a combination with at least one of the following alloying elements: Si, Cu, Mg, Fe, Ti, Zn, Zr, Mn, Ni, Sr, B, Ca, or a combination thereof.

In another example, an alloy includes an amount of aluminum in balance with up to a total amount of 5 wt. % lanthanum (La) in a combination with at least one of the following alloying elements: Si, Cu, Mg, Fe, Ti, Zn, Zr, Mn, Ni, Sr, B, Ca, or a combination thereof.

In one example, a CALPHAD assessment of the ternary Al—Mg—Si equilibria may be applied to develop a Al-3.5Ce-0.4Mg-7Si alloy and other Al-RE alloys, for improved mechanical properties compared to conventional Al-based alloys, including some Cerium containing alloys (e.g., Al-8Ce-10Mg alloy). In contemplated approaches, higher amounts of Ce to obtain the binary phase $Al_{11}Ce_3$ resulted in a Ce-rich alloy having a composition of Al-19Ce-0.9Mg-1.1Si having an intermetallic compound predominantly in the binary phase $Al_{11}Ce_3$ which may have improved mechanical properties compared with a conventional Al—Ce binary phase alloys, e.g., Al-16Ce, Al-12Ce, etc. The high amounts of Ce increase the alloy melting temperature, which may limit the castability and lead to difficulty in manufacturing the alloy. The addition of ternary alloying elements (especially Si) increases the castability, manufacturability, etc. and improves mechanical properties of the alloy compared to the binary alloys. However, the small amount of ternary alloying element may lead to an Al—Ce-X ternary intermetallic compound with insufficient X (e.g., an Al—Ce-deficientX ternary intermetallic) and may create an alloy that does not respond to heat treatment, where resulting nanoparticulate strengthening conditions are not attainable due to insufficient X in the matrix.

According to various embodiments described herein, a combined knowledge of experiment, empirical relationships, theory and thermodynamic calculations may elucidate phase behavior and thereby result in computations and alloy constituent ratios that identify novel alloy compositions which improve manufacturing processes, e.g., casting, advanced manufacturing, additive manufacturing, etc. by reducing or eliminating void formation, reducing and tailoring freezing ranges and retaining alloying constituent effects such as solid solution strengthening and precipitation hardening of certain intermetallics. In some approaches, alloy compositions optimized by these methods may not only improve manufacturing processes but also may exhibit superior mechanical properties compared to alloys developed by conventional methods.

In various approaches, by including Al-RE-X intermetallic compounds with possible X=Si, Cu, Mg, Ni, Zn, etc., the ternary phases may be used as intermetallic strengtheners to undergo heat treatment for precipitation hardening to improve mechanical properties of the alloy.

In various approaches, the alloying constituent content may be derived by empirical relationships to saturate a given intermetallic compound for strengthening effects. When referring to intermetallic phases (not Al-based FCC), the term saturation, saturated, supersaturated, etc. refers to an energetic state in which an Al-RE-X based intermetallic compound no longer absorbs additional alloying element X with subsequent solution heat treatment. In the particular case where the Al-RE-X intermetallic compound is saturated, any remaining X content may be available to strengthen the Al-based FCC matrix phase, produce other desired effects, etc.

In one approach, using the following equations, the concentration of alloying element X=Si, Cu, Mg, Ni, Zn may be calculated to saturate the insoluble RE element in the RE-Al alloy, such that the insoluble element z interacts with soluble element b, max solubility of soluble element b is constant within matrix phase, main intermetallic ω is saturated with b to a constant value. In one approach, all b that is not in ω is in solution in α. The variables for calculating the fraction of soluble element b in an intermetallic, then the amount preferred to enrich matrix, then combine for total b addition are calculated such that:

$$C_{b,tot,\omega}=C_{z,tot}\cdot C_{b,\omega}''/C_{z,\omega} \quad \text{Equation 1}$$

$$C_{b,tot,\alpha}=f_{\alpha}\cdot C_{b,\alpha,max}\cdot f_{b,target} \quad \text{Equation 2}$$

$$C_{b,tot}=C_{b,tot,\omega}+C_{b,tot,\alpha} \quad \text{Equation 3}$$

and the variables included in Equations 1 through 3 are defined as:

- $f_{\alpha}$: fraction of solid-solution phase α when phase ω is saturated with b
- $f_{\omega}'$: fraction of phase ω in alloy with zero b uptake
- $f_{\omega}''$: fraction of phase ω in alloy when saturated with b
- R: Ratio of volume fractions of ω,=$f_{\omega}''/f_{\omega}'$
- $C_{b,tot}$: concentration of soluble element b in overall alloy
- $C_{b,tot,\omega}$: concentration of soluble element b in overall alloy that is trapped in phase ω
- $C_{z,tot}$: concentration of insoluble element z in overall alloy
- $C_{b,\omega}$: saturated concentration of element b in phase ω
- $C_{z,\omega'}$: internal concentration of element z in phase ω, zero b uptake
- $C_{z,\omega''}$: internal concentration of element z in phase ω when ω is saturated with b
- $C_{b,\alpha,max}$: maximum solid solubility of element b within phase α
- $f_{b,target}$: desired fraction of max solid solubility of element b in phase α

Here, the fraction of matrix, with the assumption that the intermetallic swells is given as $$f_{\alpha}=1-R\left(1-\frac{(c_{z,\omega'}-c_{z,t})}{c_{z,\omega'}}\right) \quad \text{Equation 4}$$

In this context, the amount of alloying constituent (in this case Cu) may be calculated as a function of insoluble Ce, and therefore the amount of preferred Cu addition to reach standard alloying levels in an Al-RE (in this case Ce) FCC matrix is presented in FIG. 1. As shown, the plot of solid squares (■) represents the wt. % Cu for full uptake to match 2 wt. %, and the plot of solid circles (●) represents the wt. % Cu for full uptake to match 4.5 wt. %.

In the above approach, the empirical relations may be used to normalize effective alloying element potency and should work for both atomic and weight percent, as long as they are kept consistent throughout the calculation. This calculation should also work if ω transforms to another phase.

In various approaches, designed Al-RE alloys may be applied to advanced manufacturing. In one approach, designed Al-RE alloys may be used in direct metal writing techniques. In preferred approaches, the freezing range of a molten designed Al-RE alloy allows the alloy to be used in direct metal writing techniques where the shape is formed, and then freezes into a solid material following the writing.

In preferred approaches, structures formed with designed Al-RE alloy material form a final structure without heat treatments after fabrication of the structure. The low solubility of the RE element in the Al matrix ensures that the RE element may be retained within the formed ternary intermetallics. Moreover, the low diffusion rate of RE in Al may allow the RE element to be trapped within the matrix or intermetallic compounds without causing coarsening. This is desirable because coarsening may decrease strength properties of the alloy.

The morphology of the phases may be directly determined from the melt, where plate or block morphological features are defined by the alloy composition.

The designed Al-RE alloy material may undergo precipitation hardening. For example, after the Al-RE alloy material is cast into a structure, it may undergo various solutionizing heat treatments to dissolve certain alloying constituents in a temperature range of about 350° C. to about 650° C. for a time range of about 0.5 to about 120 hours, followed by rapid quenching to ensure the matrix Al-based FCC phase is supersaturated in solute element. Subsequently, tailored aging heat treatments allow for precipitation of finely dispersed intermetallic particles (such as binary phases $Mg_2Si$ or $Al_2Cu$, any ternary phase Al-RE-X, their metastable precursors in their precipitation sequence, etc.) at temperatures from about 130° C. to about 300° C. for a time range of about 0.5 to about 120 hours, which strengthens the Al-based matrix by particle strengthening. Further, the alloy may form precipitate particles by natural aging at room temperature. During heat treatment, certain RE-bearing particles may change composition to absorb or release the relevant alloy constituents that are used to form fine precipitates.

A similar process may be applied to manufacturing processes such as extrusions, forgings, etc. where following fabrication of the structure, a heat treatment and quench may be performed to increase mechanical strength of the material.

Figure 2:
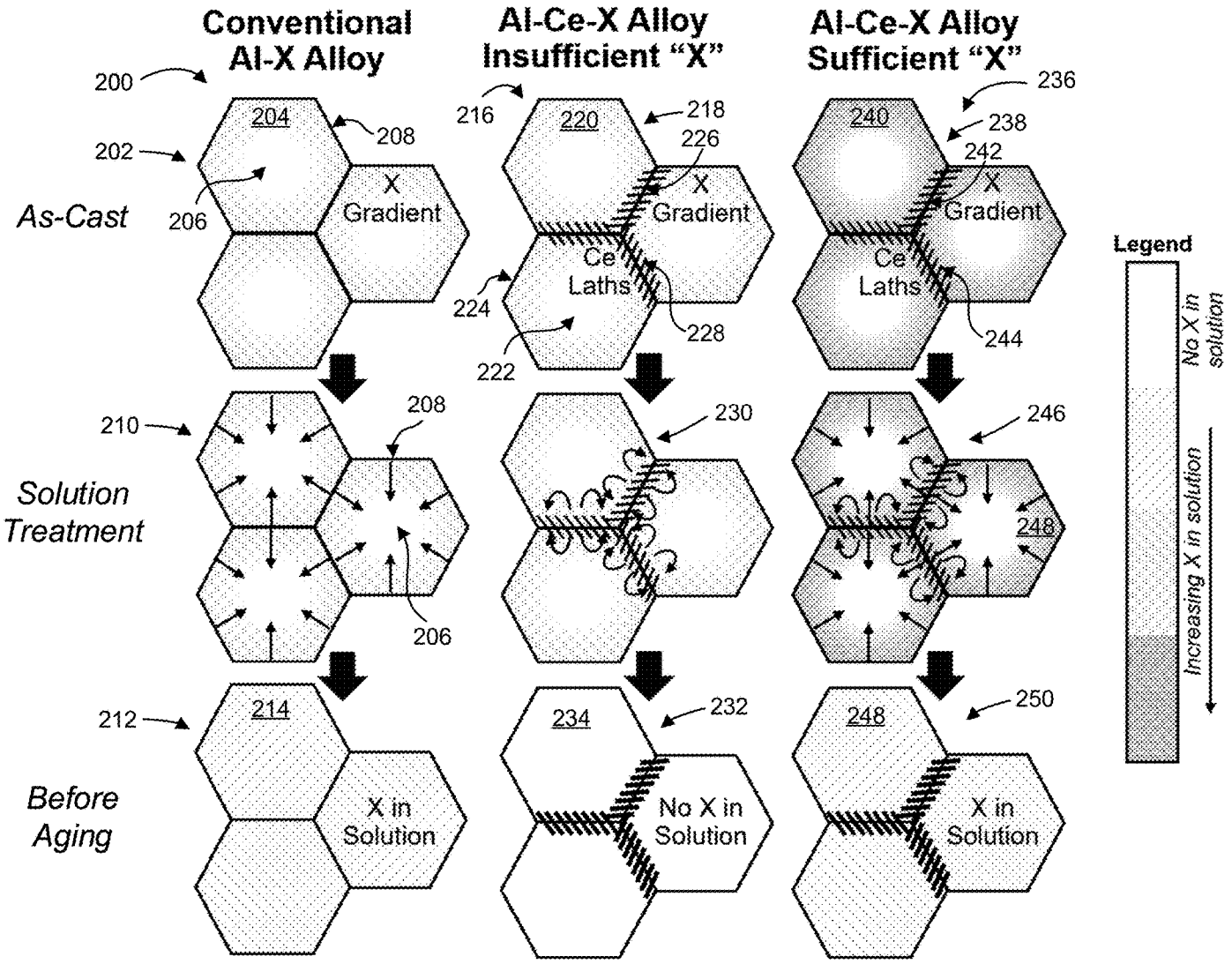
FIG. 2 is a schematic diagram of aluminum alloy structures following treatment conditions, according to various embodiments.

FIG. 2 includes a schematic drawing of an Al alloy microstructure illustrating how RE element additions (e.g., Ce as shown) and soluble alloying element "X" interact during heat treatment in various circumstances. Ce is included by way of example only and is not meant to be limiting in any way. Soluble alloying elements "X" include but are not limited to conventional additions to Al such as Cu, Si, Zn, etc.

The left column of FIG. 2 depicts a conventional Al—X alloy 200 structure. The as-cast (e.g., not heat treated) structure 202 of the Al—X alloy 200 structure usually exhibits grains 204 with a gradient of X in which less X is present in the center 206 of the structure 202 with more X present at the edge 208. This type of gradient of X is caused by the structure of phase diagrams and is generally understood to be referred to as coring. Coring is typically undesirable, as the distribution of the elements within the grains is nonuniform and thus the different regions within the internal structure of the alloy will exhibit unequal mechanical, unequal corrosion response, etc.

Solution treatment 210 of the Al—X alloy as-cast structure 202 may be performed to fix the undesirable coring effect. Typically, the solution treatment 210 includes heating the Al—X alloy as-cast structure 202 to a temperature in a range of 400° C. to 600° C. This high temperature heat treatment provides solubility and mobility for X atoms, such that the composition gradient smooths out (as indicated by arrows directed from the edge 208 to the center 206).

The solution treatment 210 of the Al—X alloy as-cast structure 202 results in the before-aging 212 structure. The Al—X alloy before-aging 212 structure is comprised grains 214 with X in solution. The before-aging 212 structure may undergo an aging process at lower temperature (e.g., for example, at a temperature in a range of typically 150° C. to 250° C.), where the lower solubility for X may cause Al—X-type precipitates to form, usually imparting a significant strength improvement to the matrix and material as a whole.

The addition of Ce to the Al—X alloy system may be desirable in some cases, however, the addition of Ce may complicate the alloying potency for X. The center column of FIG. 2 illustrates an Al alloy with a deficient, e.g., insufficient, amount of X and Ce, the Al—Ce-deficientX alloy 216. The as-cast structure 218 of the Al—Ce-deficientX alloy 216 has a distribution of X that similar to that in a conventional Al—X alloy as-cast 202 structure having grains 220 with a gradient of X in which less X is present in the center 222 of the structure 218 with more X present at the edge 224. However, the near zero solubility of Ce in the Al grains 220 tends to push the Ce to the grain boundary 226 where Al—Ce-based intermetallic compound 228 form, e.g., as indicated "laths."

During the solution treatment 230 of the Al—Ce-deficientX alloy as-cast structure 218, e.g., high heat treatment of the alloy, the Al—Ce-based intermetallic compounds 228 tend to interact (as shown by curved arrows) with the X content in the alloy, such that the Al—Ce-based intermetallic compounds 228 become enriched in X.

The solution treatment 230 of the Al—Ce-deficientX alloy as-cast structure 218 results in a structure 232 in which all the X has been absorbed into the intermetallic compounds 228 the solution 234 of the structure essentially has no X present in the solution 234 for a subsequent heat treatment.

The right column of FIG. 2 illustrates an Al alloy with a sufficient amount of X and Ce, the Al—Ce—X alloy 236. The alloying component X may include multiple alloying components, for example Si and Cu; Si, Cu, and Mg; any combination of the following: Si, Mg, Cu, Zn, La, Ni, Fe, Zr, etc.

The alloy 236 includes greater amounts of X than included in the Al—Ce—X alloy 216. The as-cast structure 238 of the Al—Ce—X alloy 236 having a sufficient amount of X has a similar structure characterization as the as-cast structure 218, but as indicated by darker shading the amount of X in solution is greater in the as cast structure 238. Again, the near zero solubility of Ce in the Al grains 240 tends to push the Ce to the grain boundary 242 where Al—Ce-based intermetallic compounds 244 form.

During the solution treatment 246, X interacts with the Al—Ce intermetallic compounds 244, but the Al—Ce intermetallic compounds 244 become saturated in X such that there is still X available in solution 248 for subsequent property improvement.

Thus, the solution treatment 246 of the Al—Ce—X as-cast structure 238 results in the before-aging 250 structure. The Al—Ce—X alloy before-aging structure 250 may undergo an aging process since there is still X available in the solution 248.

TABLE 1

Mechanical Properties of Al—Ce—X Alloys

| Alloy Composition | Type of Intermettalic Al11Ce/Al—Ce—X | Sufficient/Deficient Al—Ce—X | UTS (MPa) | Yield Strength (MPa) |
|---|---|---|---|---|
| A356-3.5Mm-F | Al—Ce—Si | sufficient | 159 | 103 |
| A356-3.5Mm-T6 | Al—Ce—Si | sufficient | 253 | 211 |
| Al—19Ce—0.9Mg—1.1Si—F | $Al_{11}Ce_3$ & Al—Ce—Si | deficient | 152 | 83 |
| Al—19Ce—0.9Mg—1.1Si-T6 | $Al_{11}Ce_3$ & Al—Ce—Si | deficient | 145 | 76 |
| A206-8Ce (T4) | $Al_{11}Ce_3$ & Al—Ce—Cu | deficient | 131 | 60 |

Alloy compositions with insufficient X/RE ratio may not lead to improved mechanical properties, e.g., tensile and yield strength, following heat treatment. In one example, alloy compositions with various ternary addition were tested for tensile and yield strength as shown in Table 1. The alloys with sufficient ternary additions (sufficient X) tend to respond well to heat treatment and result in improved mechanical properties, e.g., A356-Mm-T6. The compositions with insufficient X/RE ratio tend not to exhibit improved mechanical properties following heat treatment. These results are by way of example only and are not meant to be limiting in any way.

Figure 3:
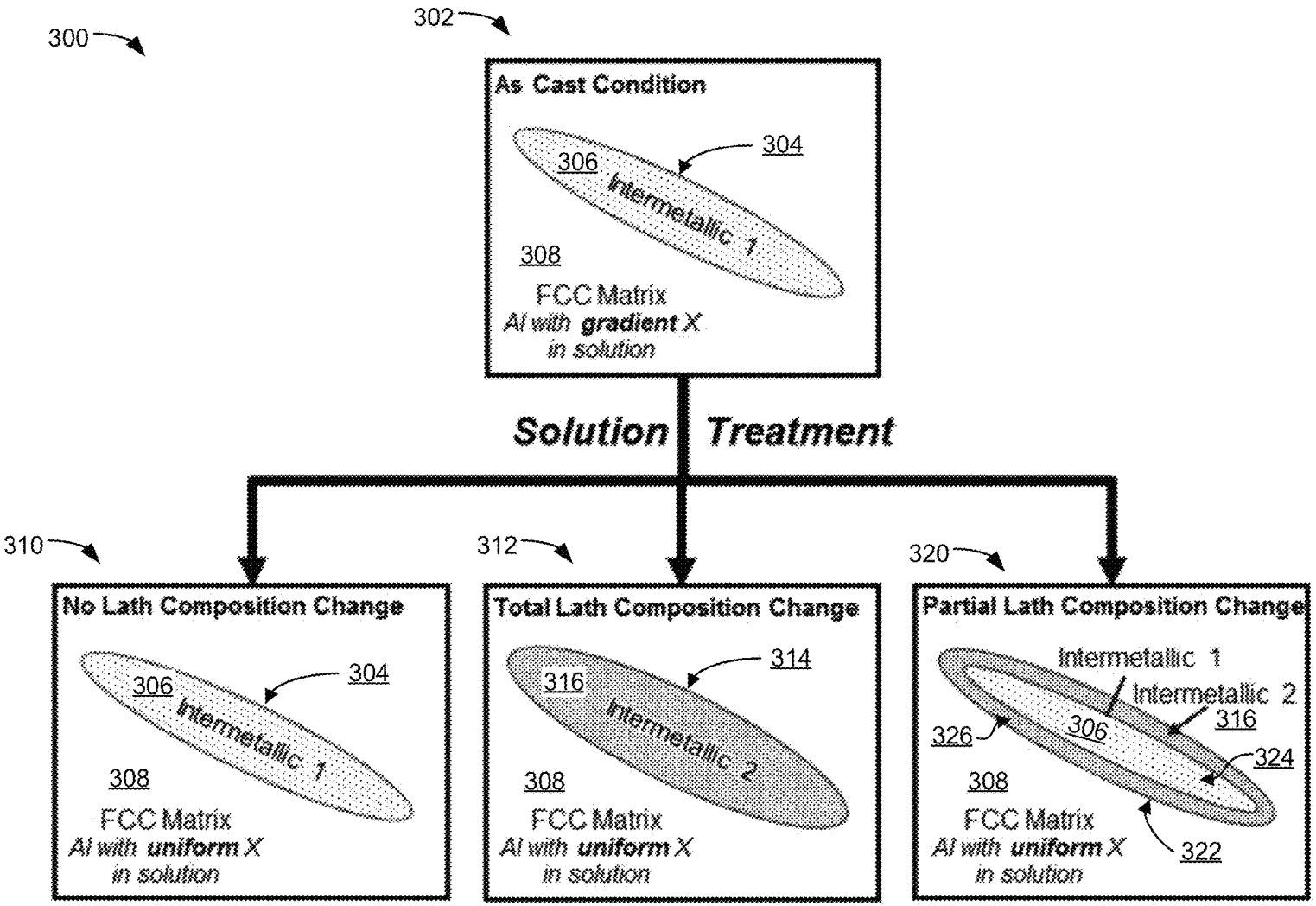
FIG. 3 is a schematic diagram of changes in intermetallic particles during heat treatment, according to some embodiments.

FIG. 3 is a schematic diagram 300 that illustrates different changes in intermetallic particles during heat treatment, e.g., solution treatment. In one embodiment, an Al-RE-X alloy has a structure that includes a plurality of intermetallic particles surrounded by an Al matrix positioned around the particles. For example, as shown in FIG. 3, an as cast condition of an Al alloy 302 includes an intermetallic particle 304 comprising an intermetallic compound 306 and an FCC matrix 308 that includes Al with gradient alloying element X in solution.

A solution heat treatment is performed to the as cast alloy for uniform distribution of the alloying element X in the FCC matrix. Depending on the particular alloy and phase stability, the intermetallic particles may remain unchanged, transform to a completely different phase intermetallic, or may partially transform such that the particle includes a core of a first intermetallic compound and a shell with a second intermetallic compound. In some instances, the second intermetallic compound in the shell may include higher amounts of the alloying element X compared to the first intermetallic compound.

As illustrated in FIG. 3, shown in an alloy having unchanged particles 310, the Al alloy may have no lath composition change, thereby exhibiting the same intermetallic particles 304 as before solution treatment. As shown in total change 312 of intermetallic particles of the alloy, a total lath composition change may be exhibited by a transformed intermetallic particle 314 comprising a different intermetallic compound 316. The FCC matrix 308 may have some changes. For example, the amount of alloying element X in the matrix may vary depending on various considerations, e.g., the composition of the first intermetallic compound 306, the composition of the second intermetallic compound 316, the average diameter of the core 324 of the particle 322, the thickness of the shell 326 of the particle 322, etc.

In another change 320 of the alloy following heat treatment, the alloy may exhibit a partial lath composition change. Each intermetallic particle 322 may have a structure including a core 324 having an intermetallic compound 306 and a shell 326 surrounding the core 324. The shell 326 may have an intermetallic compound 316 that is different form the intermetallic compound 306 of the core 324. The intermetallic compound 316 of the shell 326 may include greater amounts of alloying element X compared to the intermetallic compound 306 of the core 324. These illustrations are by way of example only and are not meant to be limiting in any way.

In one approach, the alloying element is present in the Al-based matrix after a standard solutionizing heat treatment and quench process. As shown in FIG. 3, the Al matrix includes a uniform distribution of alloying element X in solution. In one approach, the core includes aluminum and a rare earth element. The shell includes at least one Al-RE-X intermetallic compound and the matrix includes an alloying element X that is not included in the Al-RE-X intermetallic compound.

A similar process may be applied to near-net-shape manufacturing processes (e.g., advanced manufacturing, additive manufacturing, 3D printing, etc.) where following fabrication of the structure, the structure is heated and quenched thereby forming a structure with increased mechanical strength.

In one embodiment, compositions of Al—Ce alloys may be designed and fine-tuned using a CALPHAD (CALculation of PHAse Diagrams) method that includes applying parameters of thermodynamics of components for developing Al-RE alloys for advanced manufacturing, additive manufacturing, casting, etc. In various approaches, the addition of Ce to Al-based alloys, e.g., A356, A390 and A206 alloys, Al—Mg alloy, Al—Si and Al—Cu alloys, etc. may improve mechanical and physical properties including ductility, yield, tensile strength, etc. compared to previous generations of Al—Ce containing alloys.

CALPHAD Database

The CALPHAD method uses mathematical models with adjustable parameters to represent Gibbs energy functions for any structure and phase. The model parameters are optimized using critically selected thermochemical and constitutive data as input. Once such functions have been assessed to reproduce thermodynamic properties and phase diagrams (ideally for all binary and ternary systems) they are compiled in a database for use in computational thermodynamic predictions across multicomponent materials. The strength of the CALPHAD method relies on the ability of the assessed database to be self-consistent and thus can be combined to predict the thermodynamic behavior of multicomponent systems.

For the pure elements, the Gibbs energy function for the element X (X=Al, Ce, Cu, Fe, La, Mg, Ni, Si, Zn, Zr) in the pure phase ϕ and omitting here, for simplicity, the pressure dependence and the magnetic contribution, is generally written as:

$$^{0}G_X^{\phi}=G_X^{\phi}-H_X^{SER}=a+bT+cT\ln T+dT^2+eT^3+fT^{-1}+g_nT^n \quad \text{Equation 5}$$

where $H_X^{SER}$ is the molar enthalpy of element X, at 298.15 K and 105 Pa, and in its standard element reference (SER) state, i.e., Al (FCC), Ce (FCC), Cu (FCC), Fe (BCC), La (DHCP), Mg (HCP), Ni (FCC), Si (diamond), Zn (HCP), Zr (HCP), and T is the absolute temperature. The empirical parameters (a-g) are taken from optimized data. The liquid, FCC, BCC, HCP, DHCP, and diamond solution phases are modelled as substitutional solutions yielding the following molar Gibbs energy expression for a phase ϕ:

$$G_m^{\phi}=\Sigma_i x_i^{\phi}\,{}^{0}G_i^{\phi}+RT\Sigma_i x_i^{\phi}\ln x_i^{\phi}+{}^{ex}G_m^{\phi} \quad \text{Equation 6}$$

where the first term represents the mechanical mixing of end-members ($^{0}G_i^{\Phi}$ are the Gibbs energies of the pure elements in the structural state ϕ), the second term represents the contribution due to the ideal entropy of mixing, and the third term ($^{ex}G_m^{\Phi}$) represents the excess molar Gibbs energy. Using the Redlich-Kister form to represent the excess Gibbs energies of the limiting binaries, according to the Muggianu extrapolation formula, the excess Gibbs energy (from the binary interactions), of a multicomponent system is:

$$^{ex}G_m^{\phi}=\Sigma_i\Sigma_{j>i}c_ic_j\Sigma_{k=0}^{pk}L_{i,j}^{\phi}(c_i-c_j)^k \quad \text{Equation 7}$$

The Redlich-Kister model parameters, $^{v}L_{i,j}^{\Phi}$, describe the deviation from ideality and are chosen such that they satisfactorily represent all available thermochemical and phase diagram data of the corresponding binaries. Generally, $^{v}L_{i,j}^{\Phi}$ is expressed as:

$$^{v}L_{i,j}^{\phi}=a+bT+cT\ln T+\ldots \quad \text{Equation 8}$$

The excess Gibbs energy can also include, if needed, ternary interaction parameters (e.g., $L_{Al,Mg,Si}^{\Phi}$) for a multicomponent system, as:

$$^{ex,tern}G_m^{\phi}=x_{Al}x_{Mg}x_{Si}L_{Al,Mg,Si}^{\phi}, \quad \text{Equation 9}$$

where $$L_{Al,Mg,Si}^{\phi}=v_1\,{}^{0}L_{Al,Mg,Si}^{\phi}+v_2\,{}^{1}L_{Al,Mg,Si}^{\phi}+v_3\,{}^{2}L_{Al,Mg,Si}^{\phi}, \quad \text{Equation 10}$$

with $$v_1=x_{Al}+\frac{1-x_{Al}-x_{Mg}-x_{Si}}{3} \quad \text{Equation 11}$$

$$v_2=x_{Mg}+\frac{1-x_{Al}-x_{Mg}-x_{Si}}{3} \quad \text{Equation 12}$$

$$v_3=x_{Si}+\frac{1-x_{Al}-x_{Mg}-x_{Si}}{3} \quad \text{Equation 13}$$

In the case of a ternary system (Al—Mg—Si), (Eq. 10) reduces to:

$$L_{Al,Mg,Si}^{\phi}=x_{Al}\,{}^{0}L_{Al,Mg,Si}^{\phi}+x_{Mg}\,{}^{1}L_{Al,Mg,Si}^{\phi}+x_{Si}\,{}^{2}L_{Al,Mg,Si}^{\phi}, \quad \text{Equation 14}$$

with $$^{v}L_{Al,Mg,Si}^{\phi}=a'bT \quad \text{Equation 15}$$

For stoichiometric (line) compounds, the Gibbs energy can be written in its simplest form as:

$$G^{AXBY\ldots}=\Sigma_{I=A,B,\ldots}x_I\,{}^{0}G_I^{\phi_I}+a+bT \quad \text{Equation 16}$$

where a+bT represents the Gibbs energy of formation □$G^f$ of a specific compound formed from the pure elements considered in their states $\phi_I$ with compositions $x_I$ (equivalent to the stoichiometric coefficients). These states may be a given phase (structure) that is either identical to the compound, the SER state of each element (generally accepted), or any other reference state. The model parameters a and b represent the enthalpy and the entropy of formation of the compound, respectively. In fact, the entropy of mixing for an ideal solution presented above for multicomponent solution phases is equal to 0 for stoichiometric compounds, since there is no random mixing. The formalism presented here follows the Neumann-Kopp approximation, i.e., the heat capacity ($C_P$) is the weighted average of the $C_P$ of the pure elements.

Moreover, non-stoichiometric compounds exhibiting a range of solubilities (e.g., C15 phase) are modelled using sublattice models.

The 10-component database {Al—Ce—Cu—Fe—La—Mg—Ni—Si—Zn—Zr} as described herein, includes assessed Gibbs energy parameters for each of the 45 binary systems: Al—Ce, Al—Cu, Al—Fe, Al—La, Al—Mg, Al—Ni, Al—Si, Al—Zn, Al—Zr, Ce—Cu, Ce—Fe, Ce—La (ideal mixing), Ce—Mg, Ce—Ni, Ce—Si, Ce—Zn, Ce—Zr, Cu—Fe, Cu—La, Cu—Mg, Cu—Ni, Cu—Si, Cu—Zn, Cu—Zr, Fe—La, Fe—Mg, Fe—Ni, Fe—Si, Fe—Zn, Fe—Zr, La—Mg, La—Ni, La—Si, La—Zn, La—Zr, Mg—Ni, Mg—Si, Mg—Zn, Mg—Zr, Ni—Si, Ni—Zn, Ni—Zr, Si—Zn, Si—Zr, Zn—Zr. In addition, parameters for 23 ternary systems are included: Al—Ce—Cu, Al—Ce—Mg, Al—Ce—Si, Al—Cu—Fe, Al—Cu—Si, Al—Cu—Mg, Al—Cu—Zn, Al—Cu—Zr, Al—Fe—Si, Al—Fe—Zr, Al—Mg—Si, Al—Si—Zn, Ce—Fe—Zn, Ce—Mg—Si, Ce—La—Mg, Cu—Fe—Si, Cu—La—Ni, Fe—La—Zn, Fe—Mg—Si, Fe—Si—Zn, La—Mg—Si, La—Mg—Zr, Mg—Si—Zn.

In one embodiment, new alloys may be developed using the developed database as described with equilibrium calculations, phase diagrams, property diagrams, isotherms, heat capacity, heat of transformation, solidification simulations, among other thermodynamic grounded calculations, etc.

In various embodiments described herein, a CALPHAD database may be developed for an Al—Ce—Cu—Fe—La—Mg—Ni—Si—Zn—Zr multicomponent system. Within this framework, assessments of the binary and some ternary systems may be considered, and various Al—Mg—Si ternary liquid parameters may improve compatibility with constituting binary systems.

The database may be applied in combination with computational constraints as described herein to investigate new Al—Ce—Mg—Si alloys and other Al—Ce—X alloys by optimizing melting temperature (liquidus or solidus), solidification ranges (equilibrium or Scheil solidification), precipitating components, and examining the impact of alloying constituents across composition and temperature ranges.

A computational thermodynamics optimization framework may accelerate the discovery of new Al—Ce alloys for casting and other manufacturing (e.g., additive, extrusion, forging, etc.) applications. The process includes a global constrained search engine coupled to the developed CALPHAD databases to perform rapid alloy optimizations over large composition-phase domains.

In one approach, by using thermodynamic-grounded data as input (CALPHAD-based Thermo-Calc calculations) to the constrained black-box optimization (e.g. optimizing the melting temperature of an alloy with constraints imposed on phases during solidification), it may be possible to efficiently search for optimal alloys in large, multicomponent systems. In preferred approaches, the search for optimal alloys over a multicomponent phase space can be automated, whereas typical CALPHAD calculations tend to be limited to a single alloy composition per calculation.

Aluminum-Rare Earth Element (Al-RE) Alloys

In one embodiment, an Al-RE alloy includes an alloying element that is a combination of a first alloying element and at least one second alloying element that is different from the first alloying element. At least one intermetallic compound of the alloy includes Al-RE-first alloying element. For example, without being limiting in any way, an Al-RE alloy may be an Al—Ce—Mg—Si alloy that includes a ternary intermetallic compound Al—Ce—Si. In one approach, the second alloying element may have a partial occupancy of the at least one intermetallic compound Al-RE-the first alloying element. Partial occupancy refers to the substitution of a different atom within an intermetallic site. Typically, a compound has a structure where each atom of the compound is positioned at a specific site that is inherent to the crystal structure. A partial occupancy refers to a different atom substituting on one of the atom sites of a given compound, however, the substitution changes the composition but not the structure of the compound. For example, a compound $AlCeSi_2$ may have Cu in a partial occupancy where a Cu substitutes at a Si site thus resulting in a compound $AlCeSi_2$ having a percentage of the Si sites substituted by Cu thereby changing the composition of the compound, but not the structure.

For example, without being limiting in any way, and Al-RE alloy may be an Al—Ce—Cu—Si alloy that includes a ternary intermetallic compound Al—Ce—Si with some Cu substituted for Si. In another example, the second alloying element may form a quaternary intermetallic compound.

Using ternary parameters for the Al—Mg—Si liquid phase and developed thermodynamic database for multicomponent Al—Ce containing systems, optimal Al—Ce—Mg—Si alloys may be designed. In one approach, tuning an alloy with the aid of CALPHAD may demonstrate compositional effects of the alloying elements on phase stability, including solidification ranges and precipitation ordering. For example, a composition of a designed Al—Ce—Mg—Si alloy may be comparable to a composition of conventional industrial A356 alloy with the inclusion of cerium (Ce).

Moreover, and not meant to be limiting in anyway, the amount of alloying elements Si and Mg may be constrained to 6.5 to 7.5 wt. % and 0.25 to 0.45 wt. % respectively, in accordance with A356 as a target composition. A356 is an alloy with nominal composition 7 wt. % Si and 0.35 wt. % Mg, balance Al. There is ±10-20% composition tolerance (relative to the amount of each addition) for each alloying element. With the addition of Ce, a maximum amount of the $Mg_2Si$ intermetallic strengthening phase may be retained, while keeping the solidification range within 80° C. while also inducing the precipitation of the Al-RE-X intermetallic for further strengthening.

For a modified A356 alloy (to include Ce), for example, with the composition Al-3.5Ce-0.4Mg-7Si, a Si/Ce ratio of 2:1 may be identified as beneficial to achieve solidification ranges below 80° C. for industrial casting purposes. In some approaches, the computational thermodynamic design of tuned Al—Ce alloys for casting applications may extend further for more complex multicomponent systems (up to 9 elements). Moreover, the finely tuned multicomponent systems may include additional optimization parameters (e.g., viscosity, surface tension, etc.). In one approach, a thermodynamic database may be assessed across the full composition-phase space, and therefore may be applied to other classes of alloys and used as input data for any simulation code relying on thermodynamic data (nucleation algorithm, phase-field-modeling, industrial solidification software, etc.).

According to one embodiment, computational tools based on the CALPHAD methodology may be implemented in combination with experimental effort and industrial insight to accelerate the design of high-performance aluminum-cerium-based alloys with improved mechanical and physical properties. In one approach, a CALPHAD database may cover thermodynamic description of a multicomponent Al—Ce—Cu—Fe—La—Mg—Ni—Si—Zn—Zr system. Equilibrium calculations and Scheil simulations (FIG. 7) may be performed to elucidate phase relations for the development of a new class of Al—Ce—Mg—Si alloys.

In one approach, a process includes obtaining equilibrium calculations using a database, applying the obtained equilibrium calculations to form experimental alloys, and testing the experimental alloys to determine optimal alloy compositions. For example, optimal alloy compositions may include: Al-3.5Ce-0.4Mg-7Si and Al-19Ce 0.9Mg-1.1Si. According to various processes described herein, the compositions of Al—Ce alloys may be tuned and refined. Custom-designed alloys may exhibit improvements in mechanical properties, for example, yield, tensile strength, ductility, etc., from validated experiments. Furthermore, the process of designing specific alloys may be applied to the development of high-performance Al—Ce alloys for high-temperature and light-weight materials applications.

In one approach, CALPHAD-assisted alloy design may be used to identify Al-alloy compositions that include Ce. For example, custom-designed Al—Ce-alloy compositions may demonstrate improved castability by decreasing the solidification range of the Al—Ce-alloy material. Two characteristics are important to the successful implementation of casting alloys; their fluidity and the ability to fill in shrinkage porosity that normally occurs during solidification where the cast material shrinks upon solidification due to difference in density between the liquid and solid. Alloys with lower fluidity may be tuned through modification of filling systems. The solidification characteristics of the alloy, primarily the melting temperature range and shape of percent solid vs. temperature within that range, may tune the ability of an alloy to fill shrinkage porosity in complicated castings. Thus, a key consideration of an alloy is the solidification range of the alloy. Alloys with long solidification ranges, e.g., large change in temperature ($\Delta T$), develop extensive mushy zones of coherent dendrites that prevent feeding over extended distances.

In various approaches, additional elements may be included in the Al—Ce alloy compositions. For example, additional elements may include, but are not limited to, Si, Mg, Cu, Zn, La, Ni, Fe, Zr a combination thereof, etc. In various approaches, addition of Ce may cause the alloying effects and characteristics of the additional element to be retained in the alloy. In preferred approaches, the alloying characteristics of the additional constituents saturate the added Ce to cover any intermetallic and ternary phases formed in the custom-designed alloy.

In one approach, an optimal X:RE ratio, where X can be one or a combination of alloying elements, may be determined for alloy compositions depending on application thereof. For example, a designed alloy may include a ratio of X:RE where the RE content is greater than the X content. It would be cost prohibitive to conduct hundreds of experiments to determine likely candidates for such alloys. Thus, as described herein, a process for identifying an optimal range of a composition that includes a combination of thermodynamic calculations and empirical relations provides a new feedback loop to improve development of high-strength alloys. For example, and not meant to be limiting in any way, an optimization of Si:Ce, Si:Cu, or (Si+Cu):Ce ratio by thermodynamic calculations and experimentation may ensure a ratio of Si:Ce in which the Ce content is greater than the Si content thereby allowing a ratio of Cu:Ce.

An alloy having an intermetallic compound Al-RE-X may include one or more compositions of Al-RE-X compound(s). The different compositions of the Al-RE-X compound may be present dependent on experimental conditions. Moreover, each intermetallic compound/phase Al-RE-X has a specific crystal structure that differentiates each composition. An alloy may be comprised of more than one intermetallic phase Al-RE-X, each having a unique crystal structure.

In some approaches, the alloy includes at least one respective crystal structure of each composition of ternary intermetallic compound Al-RE-X described herein. The alloy may include one or more of the Al-RE-X compounds. In various approaches, different compositions of the Al-RE-X compounds may be present dependent on experimental conditions and initial stoichiometry.

In one approach, an Al-RE alloy includes the alloying element Si. The alloy includes a ratio of the amounts of Si:RE greater than 2:1 to produce a ternary intermetallic compound Al-RE-Si and Si as a precipitate phase that is insoluble in the matrix phase (FCC-phase) of the alloy. The alloy may include Si having an elemental form and an Al-based matrix. Si may form a distinct crystallographic phase from the Al-based FCC matrix phase in which Si is an insoluble precipitate that may react with the matrix phase and/or other alloying elements. The Al-based matrix may surround the elemental Si and the ternary intermetallic compound Al-RE-Si. The Al-based matrix is an FCC structure surrounding the intermetallic phase (binary or ternary) including Si.

In one approach, the Al-RE-Si alloy may be heat treated, where the Si precipitate forms strengthening precipitates with the Al and/or other elements. In one approach, the Si may form a Si phase within the matrix. In another approach, the Si may form intermetallic compounds with Al-RE-Si. For example, the alloy may include one of the following intermetallic compounds: $AlRESi_2$, $Al_xRESi_{2-x}$, $Al_2RESi_2$, and $Al_4RE_3Si_6$, etc. In one approach, the alloy may include an intermetallic compound having the composition $RE(Si_{1-x},Al_x)_2$ where x is in a range of $0<x\leq1$.

In one approach, an Al-RE alloy includes the alloying element Cu. The alloy includes a ratio of the amounts of Cu:RE greater than 1.5:1 to produce a ternary intermetallic compound Al-RE-Cu and an Al-based matrix including Cu. For example, Cu may be soluble in the Al-based matrix phase (FCC structure) of the alloy. The Cu in the matrix phase may be heat treated to form strengthening precipitates with elements present in the matrix or intermetallic compound(s). For example, the alloy may include one of the following intermetallic compounds: $Al_8RECu_4$, $Al_{10}RE_2Cu_7$, $Al_3RECu$, $AlRECu$, $AlRE_2Cu_2$, etc. In some approaches, the alloy includes at least one respective crystal structure of each composition of ternary intermetallic compound Al-RE-Cu described herein.

In one approach, an Al-RE alloy includes the alloying element Mg. The alloy includes a ratio of the amounts of Mg:RE greater than 1:1 to produce a ternary intermetallic compound Al-RE-Mg and an Al-based matric including Mg. For example, Mg may be soluble in the Al-based matrix phase (FCC structure) of the alloy. The Mg in the Al-based matrix phase may be heat treated to form strengthening precipitates with the elements present in the matrix or intermetallic compound(s). For example, the alloy may include $Al_{13}REMg_6$. In one approach, the alloy includes at least one respective crystal structure of each composition of ternary intermetallic compound Al-RE-Mg described herein.

In one approach, an Al-RE alloy includes the alloying element Ni. The alloy includes a ratio of the amounts of Ni:RE greater than 0.8:1 to produce a ternary intermetallic compound Al-RE-Ni and an Al-based matrix including Ni. For example, Ni may be soluble in the Al-based matrix phase (FCC structure) of the alloy. The Ni in the Al-based matrix phase may be heat treated to form strengthening precipitates with elements present in the matrix or intermetallic compound(s). For example, the alloy may include one of the following intermetallic compounds: Al-RE-Ni: AlRENi, $Al_2RENi$, $Al_{23}RE_4Ni_6$, $Al_5RENi_2$, $Al_4RENi$, $Al_5RE_2Ni_5$, $Al_3RENi_2$, $Al_7RENi_2$, $Al_{17}RE_{40}Ni_{43}$, AlRENi4, etc. In some approaches, the alloy includes at least one respective crystal structure of each composition of ternary intermetallic compound Al-RE-Ni described herein.

In one approach, an Al-RE alloy includes the alloying element Mn. Arc-melted buttons with Al-13Ce-8Mn compositions show that ternary Al—Ce—Mn intermetallics and some Al—Ce binary intermetallic phases are present (see FIGS. 13 and 14). An as-cast alloy of the same compositions indicate ternary Al—Ce—X and binary Al—Ce and Al—Mn phases are present (see FIG. 15). The alloy includes a ratio of the amounts of Mn:RE greater than 0.8:1 to produce a ternary intermetallic compound Al-RE-Mn and an Al-based matrix with Mn. For example, Mn may be soluble in the Al-based matrix phase (FCC structure) of the alloy. The Mn in the Al-based matrix phase may be heat treated to form strengthening precipitates with elements present in the matrix or intermetallic compound(s). For example, the alloy may include $Al_{10}CeMn_2$. In one approach, the alloy includes at least one respective crystal structure of each composition of ternary intermetallic compound Al-RE-Mn described herein.

In one approach, an Al-RE alloy includes the alloying element Fe. The alloy includes a ratio of the amounts of Fe:RE greater than 0.8:1 to produce a ternary intermetallic compound Al-RE-Fe and an Al-based matrix including Fe. For example, Fe may be soluble in the Al-based matrix phase (FCC structure) of the alloy. The Fe in the Al-based matrix phase may be heat treated to form strengthening precipitates with elements present in the matrix or intermetallic compound(s). For example, the alloy may include one of the following intermetallic compounds: $Al_{10}REFe_2$, $Al_8REFe_2$, and $AL_8REFe_4$, etc. In some approaches, the alloy includes at least one respective crystal structure of each composition of ternary intermetallic compound Al-RE-Ni described herein.

In one approach, an Al-RE alloy includes the alloying element Zn. The alloy includes a ratio of the amounts of Zn:RE greater than 1:1 to produce a ternary intermetallic compound Al-RE-Zn and an Al-based matrix including Zn. For example, Zn may be soluble in the Al-based matrix phase (FCC structure) of the alloy. The Zn in the Al-based matrix phase may be heat treated to form strengthening precipitates with elements present in the matrix or intermetallic compound(s). For example, the alloy may include $Al_2REZn_2$. In one approach, the alloy includes at least one respective crystal structure of each composition of ternary intermetallic compound Al-RE-Zn described herein.

In some approaches, thermodynamic calculations followed by experimentation may optimize an alloy with respect to castability and mechanical properties such as yield strength and hardness. For example, an Al-10Mg-8Ce alloy may demonstrate a 11% higher tensile and 13% higher yield strength than conventional alloys, and thereby demonstrate improved as-cast strength.

In another example, a conventional alloy A390 may be optimized by the addition of Ce. Looking back to the schematic drawing of FIG. 2, the addition of Ce to an Al—X alloy preferably includes the Al—X having greater amounts of the alloying element X to complement the addition of Ce, see schematic of alloy 236 of FIG. 2. For example, conventional alloy A-390 is an alloy with nominal composition 17 wt. % Si, 4.5 wt. % Cu, and 0.6 wt. % Mg, balance Al. There is ±10-20% (relative to the amount of each addition) composition tolerance for each alloying element.

The compositions of Si and Cu in A390 allow the addition of Ce to provide strengthening and hardness in the resulting A390+Ce alloy. Without wishing to be bound by any theory, unlike a ternary Al—Ce—X case, two soluble elements (Si and Cu) are available within the A390+Ce system. Al—Ce—Si intermetallic compounds are in general known to be more stable than Al—Ce—Cu intermetallic compounds, and so the Al—Ce-based intermetallic compounds preferentially absorb Si during the solution treatment and Cu remains in solution to form strengthening precipitates. Without Si in the alloy, as shown in the schematic series of the alloy 216 in FIG. 2, the Al—Ce-based intermetallic compounds would have deleteriously absorbed Cu instead thereby allowing no Cu present in the solution of the alloy+Ce for subsequent heat treatment to form strengthening precipitates.

In various approaches, tuned Al-RE alloys may be applied to advanced manufacturing for fabricating structure of tuned Al-RE alloy material having net shape, near shape, etc. In some approaches, tuned Al-RE alloys may be used in additive manufacturing

TABLE 2

Assessed ternary parameters for the Al—Mg—Si liquid phase

| Phase | Parameter | I | II | III |
|---|---|---|---|---|
| Liquid | ${}^0L_{Al,Mg,Si}$ | 11882 | 164246 − 148.17 + T | 147000 − 113*T |
| | ${}^1L_{Al,Mg,Si}$ | −24207 | −7211.91 | −14000 |
| | ${}^2L_{Al,Mg,Si}$ | −38223 | 2680 − 148856.50 | −95000 |

techniques, for example, but not meant to be limiting in anyway, direct ink writing, direct metal writing, laser writing, three-dimensional printing, etc.

Experiments

Isopleth/vertical sections of compositions varying in 3.25 wt. %<Ce<3.75 wt. %, 6.5 wt. %<Si<7.5 wt. % and 0.25 wt. %<Mg<0.45 wt. % were calculated and analyzed to compare solidification ranges important to casting. Alloys including these compositions were verified for improved castability and mechanical testing showed improved strength up to 13% compared to the previous generation of Al—Ce alloys where as one example the Al-8Ce-10Mg (wt. %) alloy has a tensile strength of 227 MPa and a yield strength of 186 MPa.

The parameters for the liquid phase of the Al—Mg—Si system are listed in Table 2. Values in column III have been obtained from embodiments described herein. For comparison only, values in columns I and II represent parameters of prior studies. The Al-containing binary phase diagrams considered for designing new Al—Ce—Mg—Si alloys are depicted in FIG. 3 along with the Al—Ce—Si liquidus projection, which is useful to identify the dominant phases during solidification.

Figure 4:
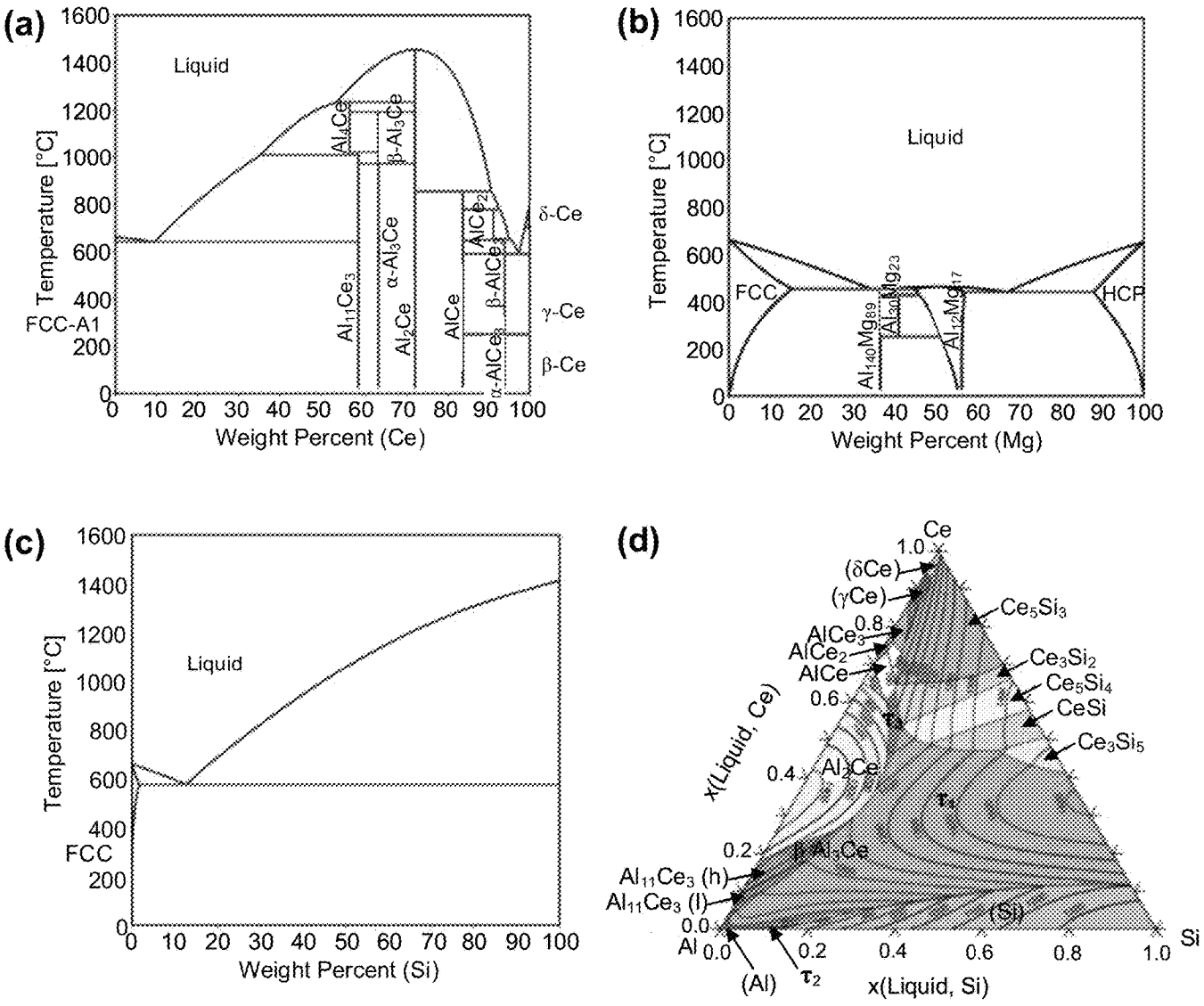
FIG. 4 depicts plots of binary phase diagrams (X=Ce, Mg, Si) for parts (a), (b)- and (c), respectively, and part (d) depicts a liquidus projection of the Al—Ce—Si ternary from 600° C. to 1600° C., according to various embodiments.

The binary phase diagram indicates that Ce solubility in Al is limited and the formation of the $Al_{11}Ce_3$ intermetallic occurs directly from the melt through a eutectic reaction (part (a) of FIG. 4). While Mg is rather soluble in Al, up to roughly 15 wt. % around 450° C., and could be used for solid solution strengthening, the Al—Mg binary (part (b)) is the source of the liquefaction at lower temperatures compared to the remaining systems. Minor amounts Si are soluble in Al and the phase diagram is characterized by a single eutectic reaction without intermetallic compounds (part (c)). The Al—Ce—Si liquidus projection indicates the primary crystallization field and includes the ternary compound τ1; an intermetallic phases with the composition $Ce(Si_{1-x}Al_x)_2$. τ1 develops from the Ce—Si binary intermetallic $CeSi_2$ and admits solubility in Al on the Si site. The stoichiometric variation x in $Ce(Si_{1-x}Al_x)_2$ ranges from 0 to 0.9.

Figure 5:
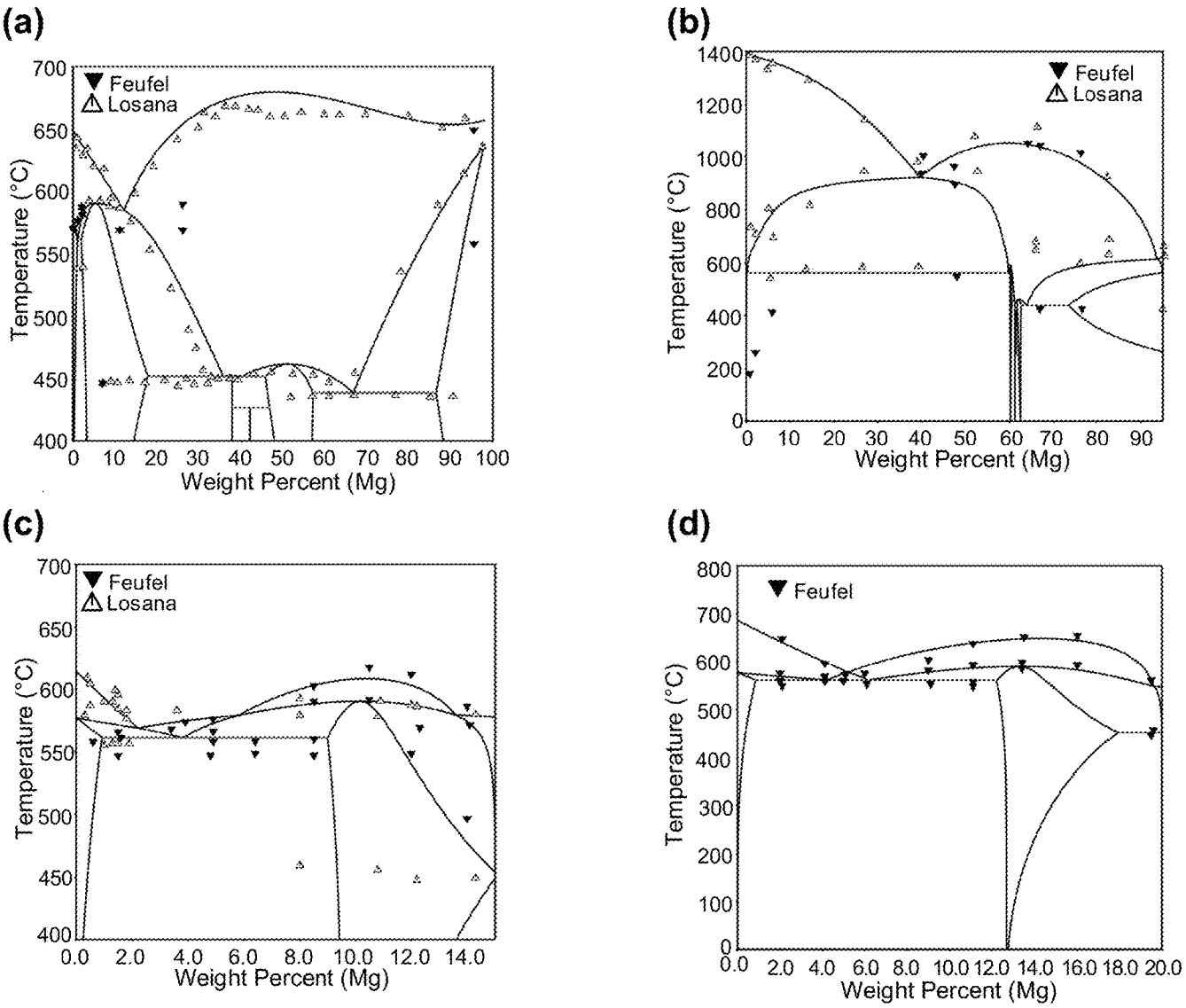
FIG. 5 depicts plots of calculated Al—Mg—Si vertical sections using the modified liquid parameters at (a) 2 wt. % Si, (b) 5 wt. % Al, (c) 85 wt. % Al, and (d) 80 wt. % Al, according to various embodiments.

The results of the newly optimized liquid parameters for the Al—Mg—Si ternary system from this work are compared to the available experiments in the literature in FIG. 5. A vertical section with 2 wt. % Si is depicted in part (a), where the agreement with experiment for liquidus data is satisfactory, however experimental discrepancies in the solidus range lead to some disagreement for the solubility limits. Prior studies have shown measurements with significant inconsistencies with respect to the solubility limits in the Al—Mg binary by minor additions of Si. As the ternary interaction parameters are only assessed for the liquid phase, the calculated phase boundaries in part (a) remain consistent with the Al—Mg solubility limits as well as previously assessed models for this ternary phase. Additional experiments with differing Al content were reproduced in the calculated vertical sections of parts (b)-(d) of FIG. 5 for 5, 85 and 80 wt. % Al. These results were consistent with previous studies describing the liquidus curve.

Using the newly assessed ternary parameters for the Al—Mg—Si liquid phase and developed thermodynamic database for multicomponent Al—Ce containing systems, an Al—Ce—Mg—Si alloy was investigated. The composition of the designed Al—Ce—Mg—Si alloy was comparable to the composition of conventional industrial A356 alloy and included the addition of Cerium. In developing this alloy with the aid of CALPHAD, it was of interest to understand the compositional effects of the alloying elements on phase stability, including solidification ranges and precipitation ordering. The amount of Si and Mg are constrained to 6.5-7.5 wt. % and 0.25-0.45 wt. % respectively, in accordance with A356 as a target composition. With the addition of Ce, it is of interest to retain a maximum amount of the $Mg_2Si$ intermetallic strengthening phase, while keeping the solidification range within 80° C. while also inducing the precipitation of the Al—Ce—X ternary intermetallic compounds for further strengthening.

Preliminary calculations indicated that by tuning the Si:Ce ratio to 2:1, the desirable solidification range, $\Delta T<80°$ C. Ce content above this value may dramatically increase the liquidus curve and thus may negatively affect the freezing range accordingly. On the other hand, excess Si may result in further suppression of the liquidus, reducing the solidification range below 60° C. in some cases. In preferred approaches, it was desirable to maximize the amount of Ce to both accomplish the objective of precipitating the Al-RE-X phases and consuming more Ce for economic co-production purposes. After thus constraining the Si/Ce content, the effect of Mg was investigated by varying the concentration within a provided range of 0.25-0.45 wt. %. This resulted in negligible effects on the solidification range, however larger Mg content may be beneficial to retain the maximum amount of $Mg_2Si$ intermetallic. Within these constraints, the optimal alloy was found to be Al-3.5Ce-0.4Mg-7Si.

The vertical sections were calculated (FIG. 6) by varying each individual constituent (Ce, Mg, Si), while constraining the remaining constituents to the composition of the aforementioned alloy. Thus, the compositional variance was solely dependent on Aluminum. The effect of each element is demonstrated as a function of composition and temperature in FIG. 6. By varying Ce (part (a)) in the alloy (92.6-x)Al-xCe-0.4Mg-7Si, it was found that low Ce content resulted in the lowest liquidus temperature and a small freezing range. Added Si in the alloy was consumed by the Si-rich $AlCeSi_2$ ternary τ2 phase as well as $Mg_2Si$, with excess Si precipitating in its elemental (diamond) phase.

Without wishing to be bound by any theory, it is believed that the liquidus temperature increases with Ce content leading to higher solidification ranges. Increasing Ce content also leads to primarily precipitating the τ1-phase of composition $Ce(Si_{1-x}Al_x)_2$, which then induces the growth of the aforementioned τ2. Eventually, as the Si/Ce ratio is inverted to 1:2, enough Si is consumed in the ternary Al—Ce—Si phases that the $Al_{11}Ce_3$ phase forms, however, this may come as a consequence of rather high solidification ranges that are not desirable for casting purposes.

Figure 6:
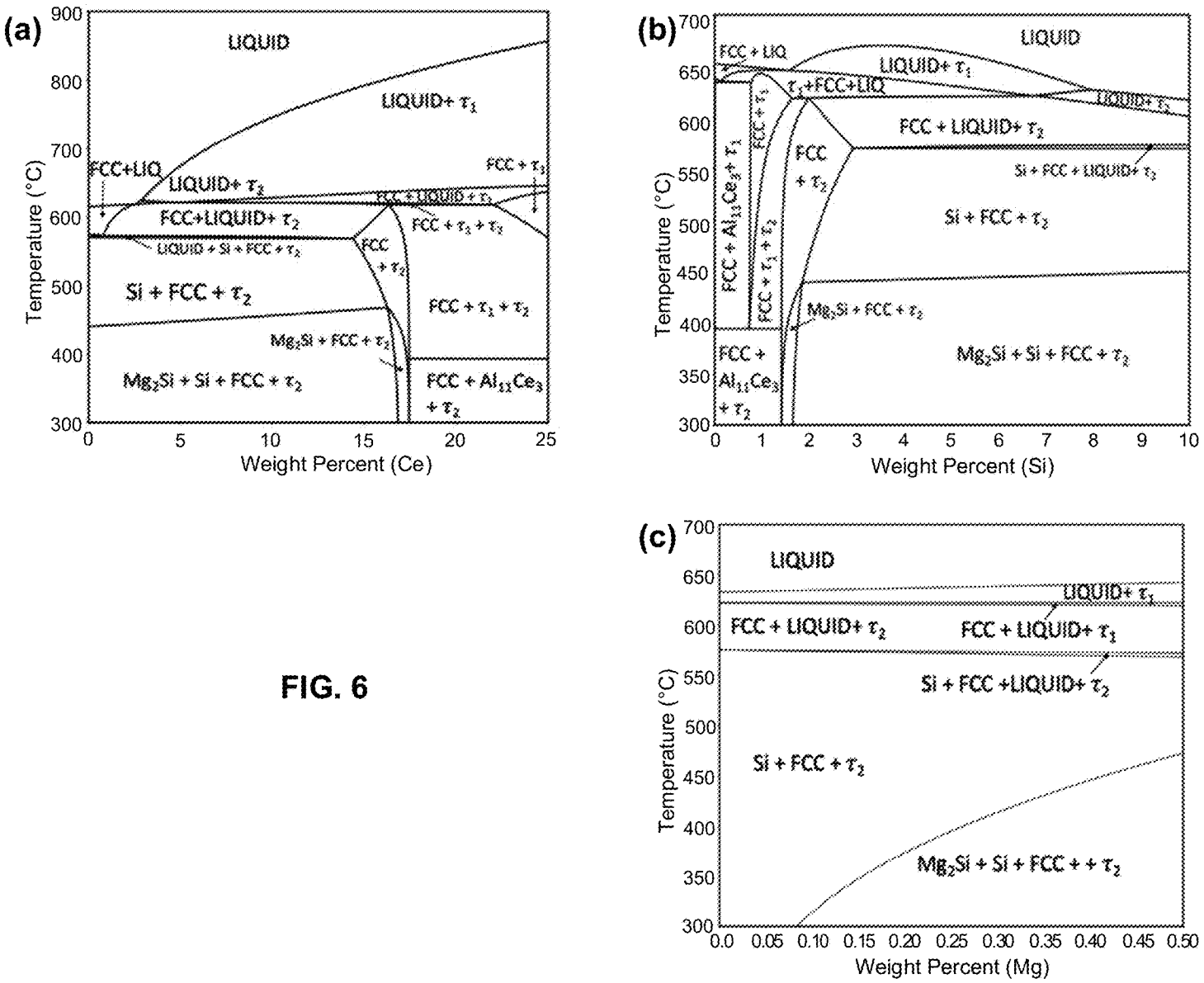
FIG. 6 depicts plots of calculated vertical sections of (a) (92.6-x)Al-xCe-0.4Mg-7Si, (b) (96.1-x)Al-3.5Ce-0.4Mg-xSi, and (c) (89.5-x)Al-3.5Ce-xMg-7Si.

A similar trend was seen in part (b) of FIG. 6 where the alloy under consideration (96.9-x)Al-3.5Ce-0.4Mg-xSi incorporates the $Al_{11}Ce_3$ phase only at low Si content in addition to the ternary τ1 and τ2 phases; Mg remains in the FCC matrix until enough Si is added to form $Mg_2Si$. Part (c) of FIG. 6 shows that a minimum of about 0.1 wt. % Mg is necessary to achieve the desired $Mg_2Si$ phase, otherwise the effect on the liquidus is rather unimportant, with only a slight increase visible within this small composition range.

The thermodynamic calculations were used to optimize the alloy with respect to castability and improvement in mechanical properties such as yield strength and hardness. An overall improvement was achieved as demonstrated by 11% higher tensile and 13% higher yield strength than the Al-10Mg-8Ce alloy and has considerably improved casting performance.

Figure 7:
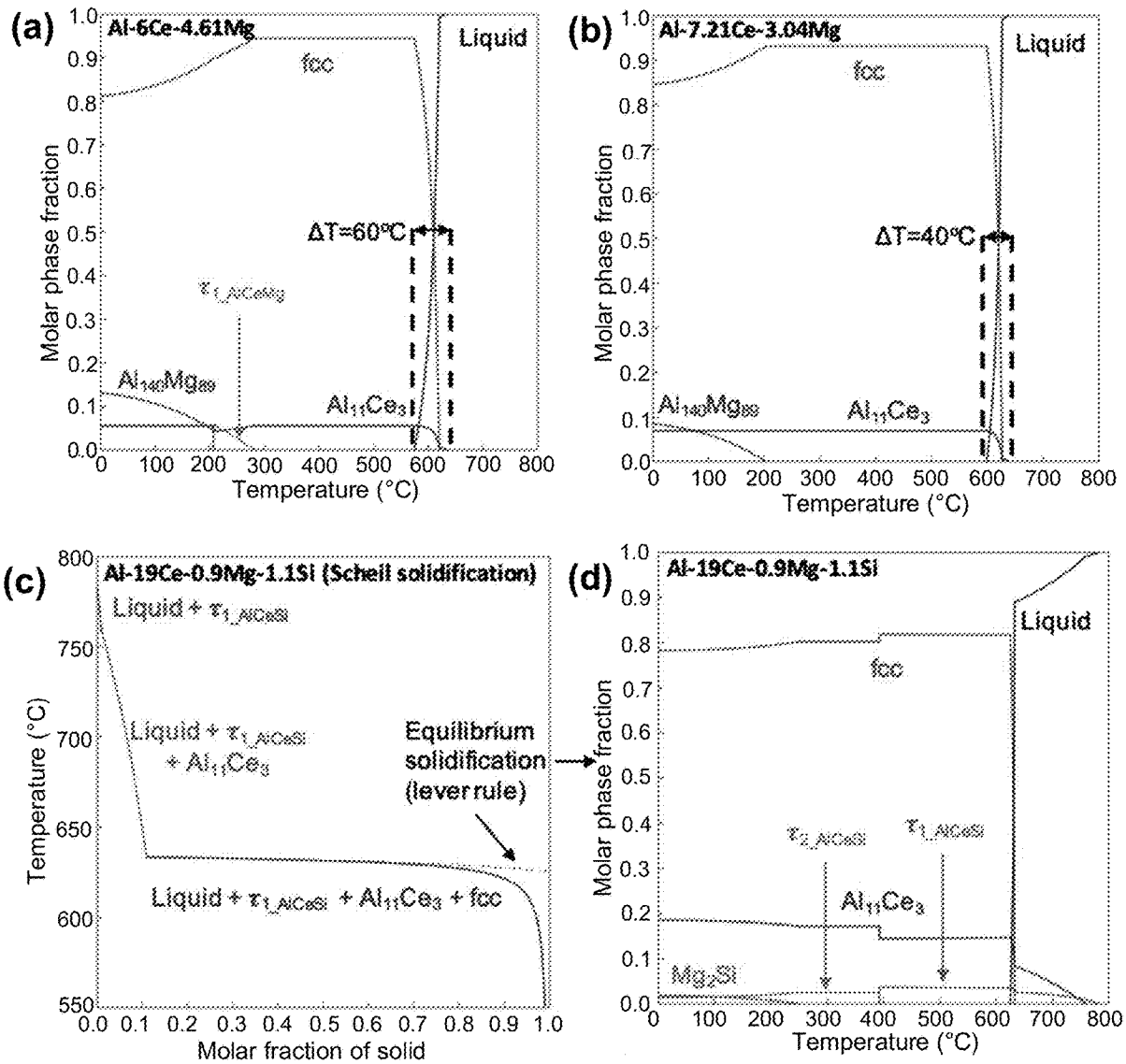
FIG. 7 depicts property diagrams (a) and (b) of Al—Ce—Mg alloys designed to produce a narrow and a wide freezing range while optimizing the liquidus and solidus temperature, respectively, according to one embodiments. Part (c) and (d) depict the Scheil and equilibrium solidification paths of the Al-19Ce-1.1Si-0.9Mg alloy, according to one embodiment.

Optimization constraints were implemented to enable searches for alloys with target minimum melting temperatures (defined as liquidus or solidus) within specified practical composition ranges and incorporating additional constraints on freezing range and phase fractions of desired solid phases formed during solidification. FIG. 7 illustrates the results of three differently constrained optimizations using the CALPHAD method and its coupling to the alloy optimization framework to design new Al—Ce alloys for casting applications.

In the first Al—Ce—Mg alloy example as shown in part (a) of FIG. 7, the liquidus temperature of the alloy was optimized within the composition limits 70<Al<96, 6<Ce<12, and 0<Mg<24.0 (in wt. %) and constraining the liquidus temperature to be no less than 600° C. and the freezing range to be exactly 60° C. under equilibrium solidification conditions. The constraints have been chosen so that the optimized melting temperature is high enough for applications (>600° C.) and still less than 700° C. to maintain a reasonable melt rate and reduce oxidation and gas pick-up from the atmosphere during casting. The imposed freezing range is used to improve the castability of the alloy.

The property diagram (evolution of equilibrium phase fraction versus temperature) of the designed Al-6Ce-4.61Mg alloy is presented in (a) of FIG. 7. The liquidus and solidus temperatures of the alloy are 635° C. and 575° C., confirming the imposed freezing range to be 60° C. The optimization process is modified in a second step as follows: the solidus temperature is now optimized, and the freezing range constrained to 40° C.

The property diagram of the designed Al-7.21Ce-3.04Mg alloy presented in part (b) of FIG. 7 exhibits a solidus temperature of 600° C. with a 40° C. freezing range. These two examples have been introduced to show that new Al—Ce—Mg alloys meeting casting and application required criteria can be rapidly developed with a modeling approach grounded in experiments. Indeed, through this computational process, optimized alloys may be provided within minutes for a 3-element system to a maximum of several days for large multicomponent systems.

In another example, the solidus temperature of the Al—Ce—Mg—Si system was optimized within the 70<Al<85, 10<Ce<20, 0<Mg<10, and 0<Si<20 (in wt. %) composition limits using the Scheil solidification model. Constraints were applied on the minimum solidus temperature (550° C.) and on the minimum amount of fcc phase formed (80%) at the end of the solidification process. The Scheil solidification path of the optimized Al-19Ce-0.9Mg-1.1Si alloy is presented in part (c) of FIG. 7. The end of the Scheil solidification occurs at 550° C. (using a 2° C. temperature step). The calculated FCC phase fraction is equal to 80.8% at the end of the Scheil solidification, meeting the imposed constraints during the optimization. In addition, a property diagram of the Al-19Ce-0.9Mg-1.1Si alloy is presented in part (d) of FIG. 7. Under equilibrium conditions, the solidus temperature reaches 625° C. and the solidified fcc phase fraction is around 0.80. This alloy, containing a large amount of Ce (19 wt. %) was casted and mechanically tested.

The thermodynamic calculations were used to optimize the alloy with ideal Si/RE, Cu/RE and Si/Cu/RE ratios, where RE may include Ce, La, etc., with respect castability and improvement in mechanical properties such as yield strength and hardness based on empirical knowledge of freezing range, phase amounts, castability and mechanical properties inter-relationships.

The alloys were cast into 1.3 cm gauge diameter tensile bars with a heated permanent mold and tested uniaxially at a strain rate of $3\times10^{-3}$ $s^{-1}$ in either as cast (F) or heat treated (T6 for A356) condition. The conventional heat treatment to a T6 condition (meaning solution treated and aged) involves heating the alloy to ~500° C., holding for 8 hours, then quickly quenching the part in water preheated to 80° C. The part is then heated to 180° C. and held for 4 hours to form nanoscale strengthening precipitates. It is worth noting that for these casting trials mischmetal (Mm), a mixture of the RE element, e.g., La, Ce, Nd, and Pr with some other impurity elements, was used in place of pure Ce.

X-ray diffraction was performed using a Panalytical X'pert Pro diffractometer equipped with a copper X-Ray source tube and k-alpha$_1$ monochromator. Samples were prepared for microscopy with standard metallographic techniques and imaged with a Hitachi S6700 scanning electron microscope (SEM) operating in backscatter electron (BSE) mode at 10 kV accelerating voltage.

The ratio of silicon to RE element has a measurable effect on reducing the alloy freezing range and an optimal ratio from the measured data appears to 2Si:1RE. overall improvement was achieved over the previous generation Al-10Mg-8Ce alloys, demonstrated by 11% higher tensile and 13% higher yield strength (see Table 2), and has considerably improved casting performance.

The cast alloy listed in Table 3, referred to as A356-3.5Mm-T6 is given in FIG. 7 with pertinent phase identification are due to the mixture of RE element within the Mischmetal (Mm).

The alloy including a large amount of Ce (19 wt. %) resulting from the alloy optimization framework (as shown in parts (c) and (d) of FIG. 7) was cast, heat treated to a T6 condition, mechanically tested and analyzed in a similar fashion to the A356-3.5Mm alloy previously discussed. The sample was also extruded at an extrusion ratio of 3:1. The microstructure shows a high volume fraction of fine $Al_{11}Ce_3$ intermetallic particles, prior eutectic microstructural constituent that spheroidized during solution treatment.

Figure 8:
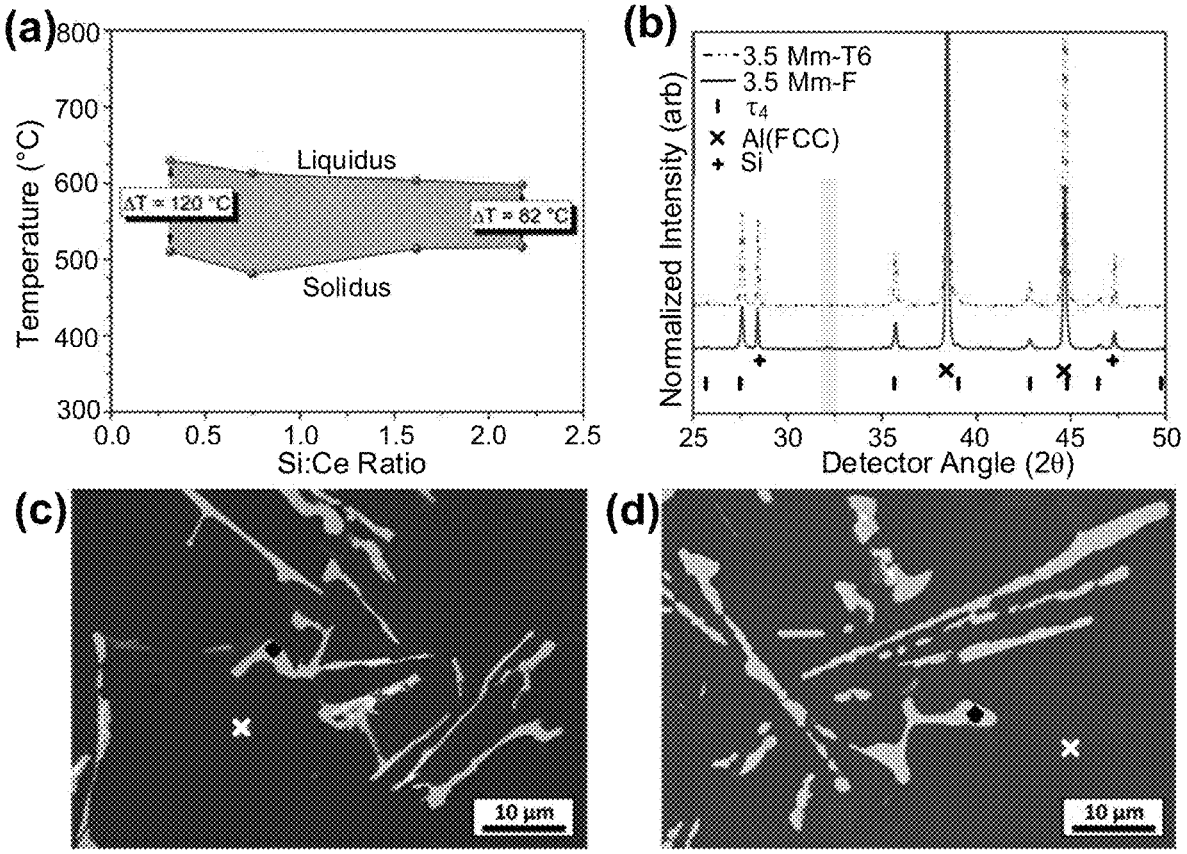
FIG. 8 illustrates properties of A356 alloys modified with rare earth (RE) elements. Part (a) is a plot of the effect of silicon to cerium ratio on alloy freezing range. Part (b) is a plot of X-Ray diffraction spectra of A356 alloys modified with 3.5Mm. Part (c) is a scanning electron micrograph (SEM) of A356-3.5Mm alloy in the as-cast condition, according to one embodiment. Part (d) is a scanning electron micrograph (SEM) of A356-3.5Mm alloy heat-treated to a T6 condition, according to one embodiment.

FIG. 8 illustrates properties of A356 alloys designed by methods described herein. Part (a) is a plot of the effect of silicon to cerium on alloy freezing range. Part (b) is a plot of X-ray diffraction spectra of A356 alloys modified with 3.5Mm. Peak indexing has been noted with symbols. The presence of Nd/Pr peak has been noted with shading. Part (c) is an SEM micrograph of A356-3.5Mm in the as-cast condition: the star (★) marks cerium rich ternary intermetallic (tau2), the diamond (♦) marks silicon rich ternary intermetallic (metastable tau4), the X (×) marks aluminum rich matrix phase. Part (d) is a SEM micrograph of A356-3.5Mm heat-treated to a T6 condition nearly showing that silicon rich tau 2 intermetallic has been transformed to metastable tau4 intermetallic.

TABLE 3

Mechanical property comparison between two recently developed Al-REE-based casting alloys

| Al-REE-based alloy | Tensile Strength | Yield Strength | Elongation |
|---|---|---|---|
| Al—8Ce—10Mg—F | 228 MPa | 186 MPa | 1% |
| A356-3.5Mm-T6 | 253 MPa | 211 MPa | 1% |

Figure 9:
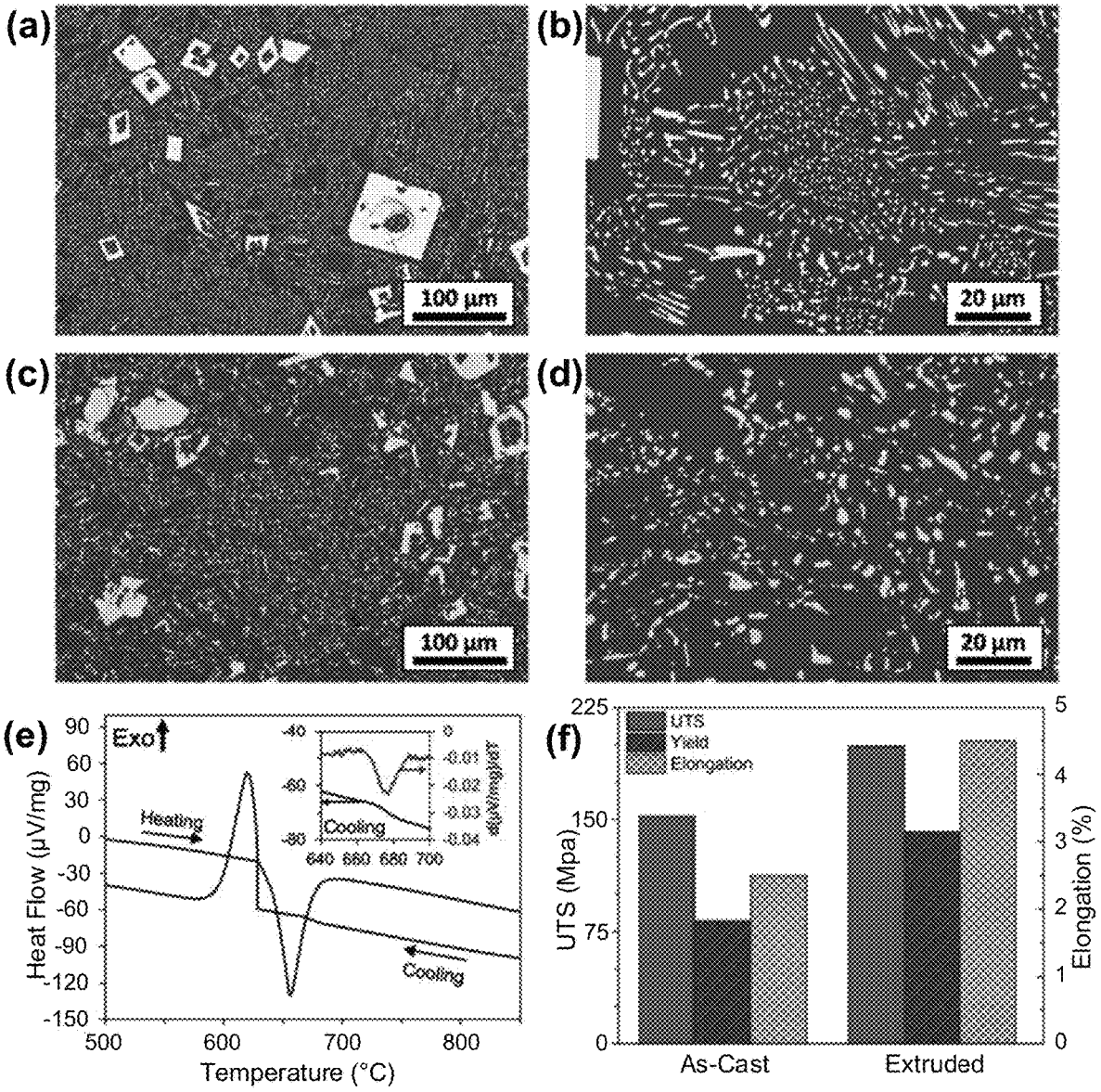
FIG. 9 includes characterizations of the Al-19Ce-1.1Si-0.9Mg-T6 alloy according to one embodiment. Parts (a) and (b) are images of microstructure of cast alloy and parts (c) and (d) are images of microstructure of extruded alloy, with (b) and (d) after T6 heat treatment conditions. Part (e) depicts the Differential thermal analysis (DTA) of the T6 alloy, showing primary solidification of intermetallic at ~680° C. Mechanical properties of the alloy in both conditions (prior to T6) are shown in part (f).

FIG. 9 illustrates various properties of the Al-19Ce-1.1Si-0.9Mg-T6 alloy. Parts (a) and (b) are images of microstructures formed from casting the alloy. Parts (c) and (d) are images of microstructures formed from extruding the alloy.

Differential thermal analysis (DTA) was performed with a Perkin Elmer Pyris Diamond TG/DTA at 20° C./min under flowing argon (part (e) of FIG. 9) and primary solidification of intermetallic was observed at significant undercooling from equilibrium (inset, part (e)). Mechanical test results demonstrate considerable ductility (2.5%) in as-heat-treated condition, especially for an alloy with such a high fraction of intermetallic. Extrusion improved all mechanical properties, likely by a combination of work hardening and refinement of large primary intermetallics that would act as failure sources.

Part (f) of FIG. 9 illustrates tensile strength (UTS), yield, and elongation of both conditions of the alloy, as cast and extruded.

Examples of Al—X Alloys

Figure 10:
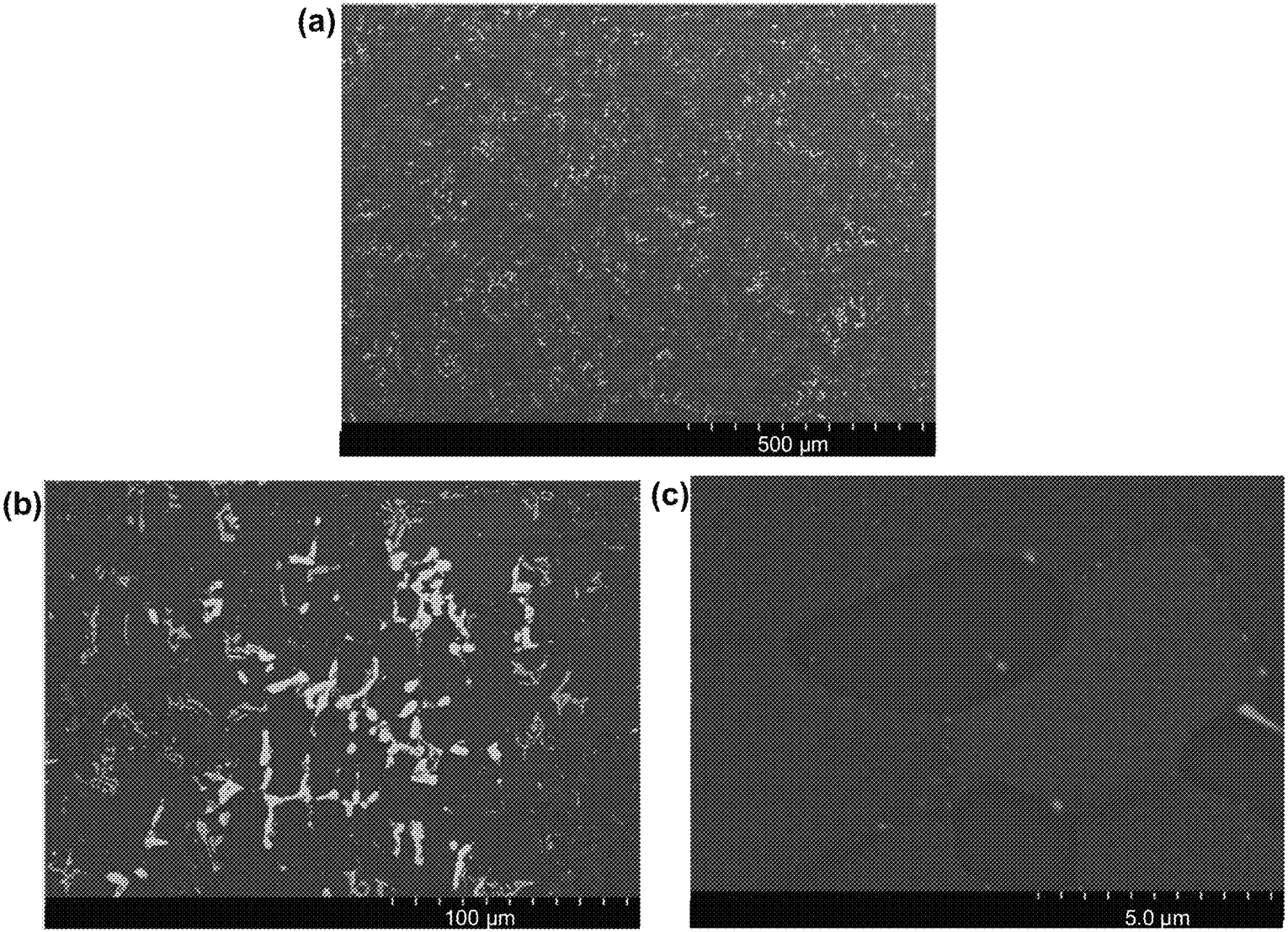
FIG. 10 is series of micrographs of a conventional A390 alloy solution treated and aged, according to one embodiment. Parts (a) and (b) are low magnification micrographs and part (c) is a high magnification micrograph.

As example of a conventional Al—X alloy solution treated and aged (similar to Al—X alloy 200 of FIG. 2), FIG. 10 depicts a series of magnifications of a conventional Al alloy A390 without Ce. The major alloying additions to the conventional A390 are approximately 4.5 wt. % Cu and approximately 17 wt. % Si. The micrographs depicted in FIG. 10 represent solution treated and aged conditions (e.g., T6). The micrographs in part (a) and part (b) represent lower magnification at 500 μm and 100 μm, respectively. Precipitates having an average length of 100-200 nm long can be seen as bright features within the darker Al FCC matrix on the magnified micrograph in part (c). These precipitates are Cu-rich and form in particular crystallographic orientations with respect to the parent Al FCC grain. The Cu precipitates are primarily responsible for the age hardening response in this alloy.

Figure 11:
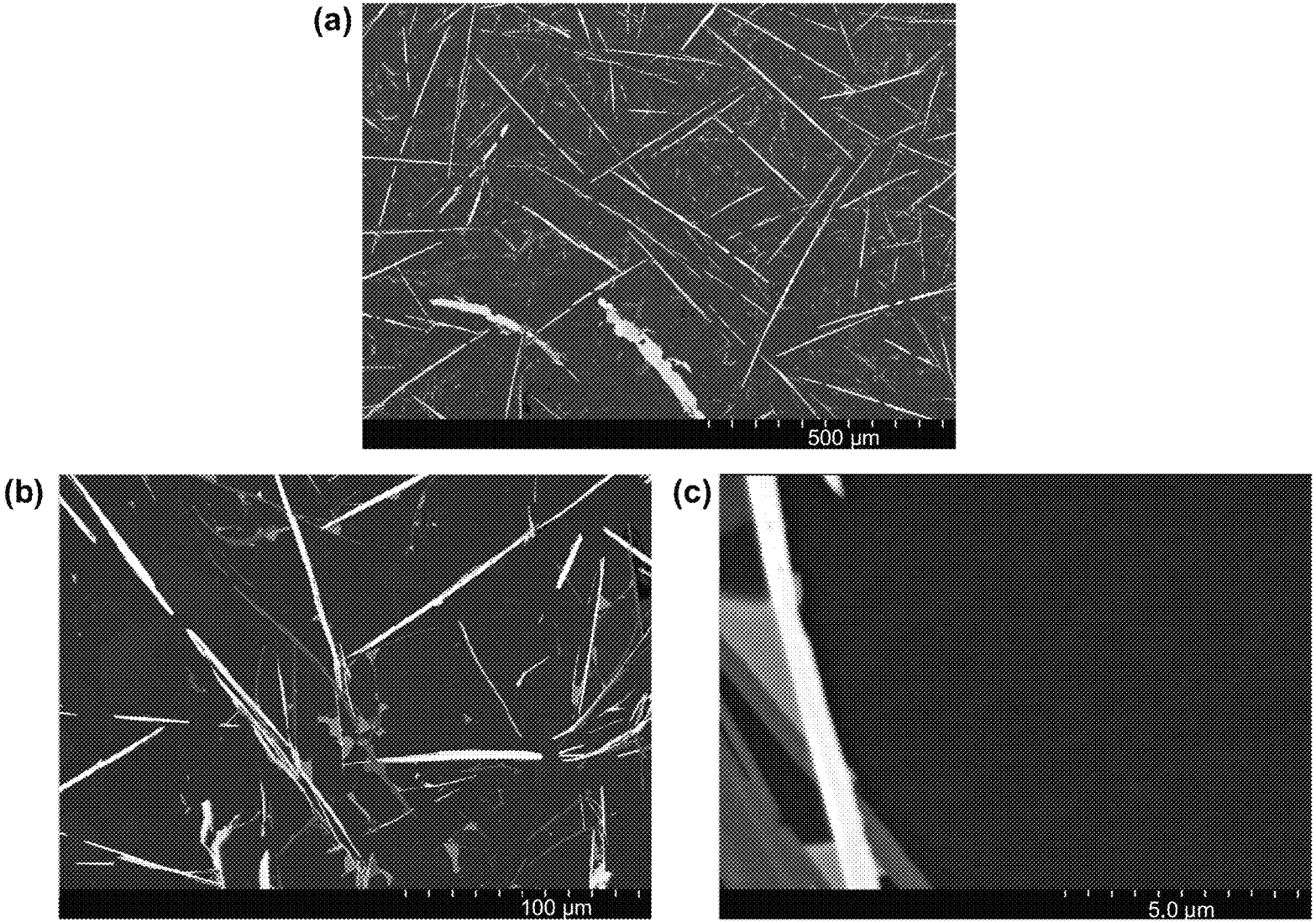
FIG. 11 is series of micrographs of a conventional A390 alloy with 8 wt. % Ce as-cast, according to one embodiment. Parts (a) and (b) are low magnification micrographs and part (c) is a high magnification micrograph.

As an example of Al—Ce—X alloy as-cast structure having sufficient X of (similar to the Al—Ce—X alloy 236 series of FIG. 2), FIG. 11 depicts a series of micrographs of the conventional alloy A390 alloy with 8 wt. % Ce added and in the as-cast condition where the X component of the alloy represents Cu. Long bright Al—Ce-based intermetallic compounds can be seen at low magnification, 500 μm and 100 μm, parts (a) and (b), respectively. As shown in part (c) at 5.0 μm, no nanoscale strengthening precipitates are seen at high magnification, as expected.

Figure 12:
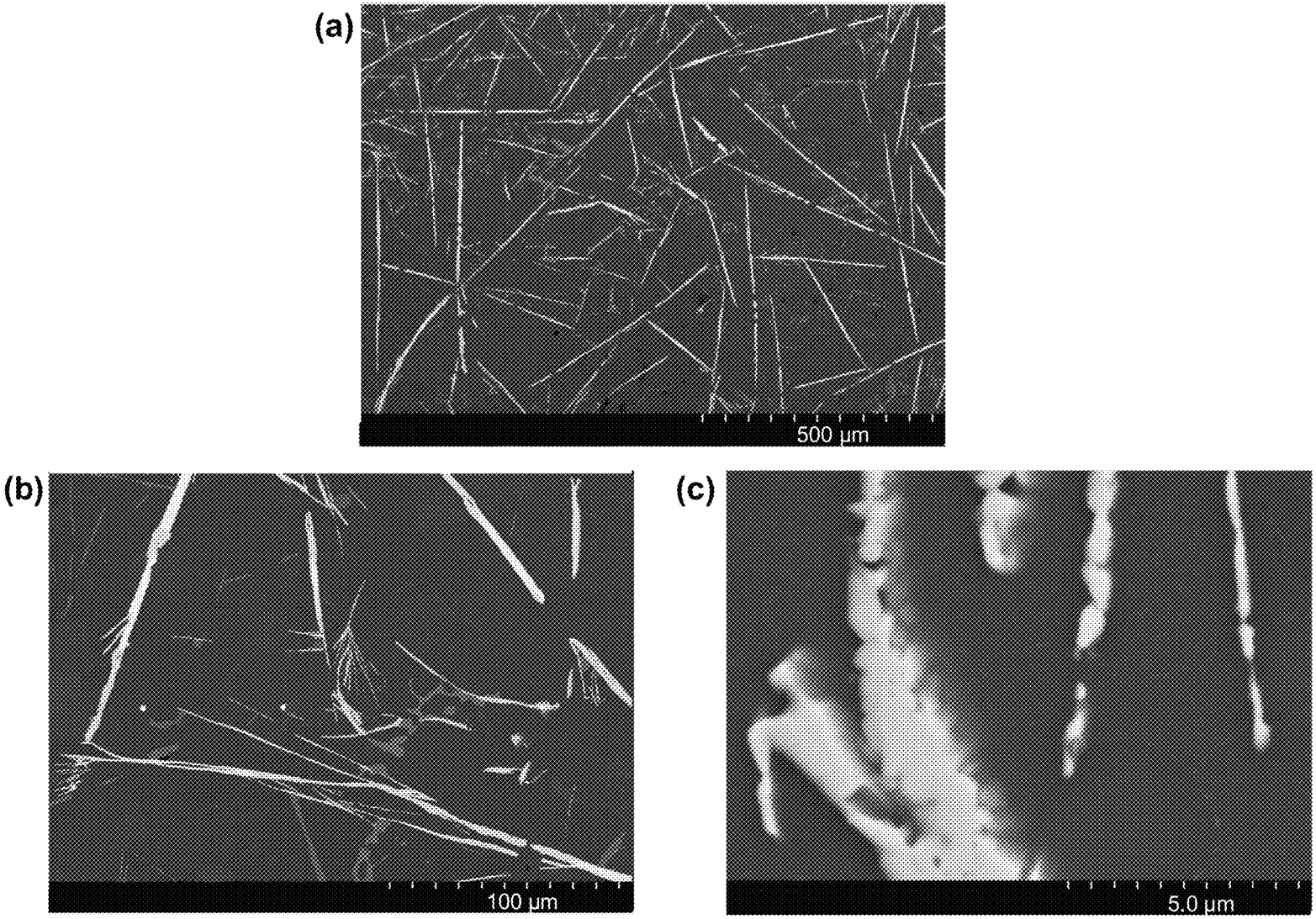
FIG. 12 is series of micrographs of a conventional A390 alloy with 8 wt. % Ce solution treated and aged, according to one embodiment. Parts (a) and (b) are low magnification micrographs and part (c) is a high magnification micrograph.

As an example of Al—Ce—X alloy structure as shown in FIG. 11 being solution treated and aged (T6) (similar to the series of Al—Ce—X alloy 236 of FIG. 2), FIG. 12 depicts a series of micrographs of the conventional alloy A390 with 8.0 wt. % Ce added. It can be seen that the Al—Ce precipitates have bulged and changed morphology, absorbing additional alloying element. Nanoscale Cu-rich strengthening precipitates are again seen at high magnification. Unlike a ternary Al—Ce—X case, two soluble elements (Si and Cu) are available within the A390+Ce system. Al—Ce—Si intermetallic compounds are in general known to be more stable than Al—Ce—Cu intermetallic compounds, and so the Al—Ce-based intermetallic compounds preferentially absorb Si during the solution treatment and Cu remains in solution to form strengthening precipitates. Without wishing to be bound by any theory, it is generally

TABLE 4

Phase Composition of Microstructures at Edge of Al—13Ce—8Mn Alloy

| Element | 1 | 2 | 3 | 4 |
|---|---|---|---|---|
| Al | 85.56 | 76.38 | 86.02 | 76.57 |
| Mn | 9.91 | 15.77 | 9.52 | 15.65 |
| Ce | 4.53 | 7.85 | 4.47 | 7.78 |

believed that in the absence of Si in the alloy, the Al—Ce-based intermetallic compounds would have deleteriously absorbed Cu instead.

Examples of Al—Ce—Mn Alloys

Figure 13:
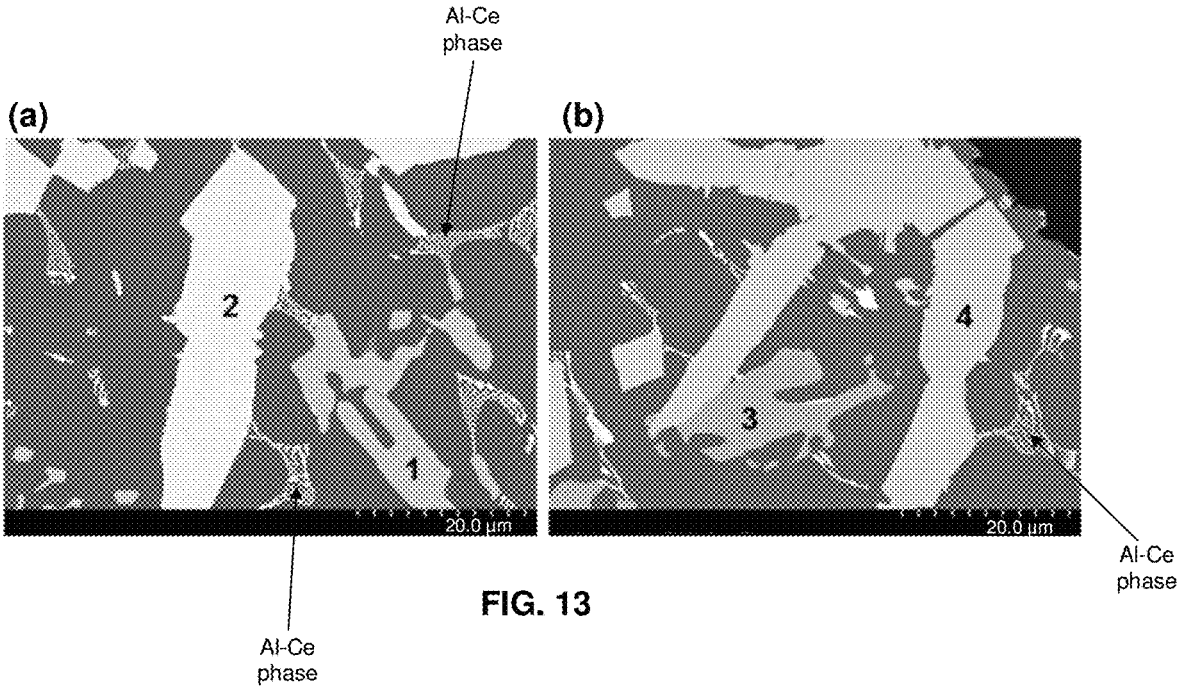
FIG. 13 is a series of micrographs images of microstructures of an arc-melted Al-13Ce-8Mn alloy near the edges of the sample alloy, according to one embodiment. Parts (a) and (b) represent different fields of regions near the edge of the ample alloy.

FIG. 13 is a series of SEM micrographs of regions near the edge of an arc-melted Al-13Ce-9Mn alloy. Parts (a) and (b) depict different fields of the regions near the edge of the alloy. The phase compositions (in terms of at. %) of the microstructures, e.g., intermetallic particles, numbered 1, 2, 3, and 4 on the images, are listed in Table 4. Two ternary intermetallic phases such that particles 1 and 3 have the same composition representing one type of ternary intermetallic phase and particles 2 and 4 having the same composition representing a second type of ternary intermetallic phase. A binary Al—Ce phase was detected by the bright white/grey region (arrow) indicated by the eutectic microstructure that results from the simultaneous formation of two phases upon solidification (in this case the Al—Ce binary phase and the Al-based FCC matrix) giving the appearance of layering.

Figure 14:
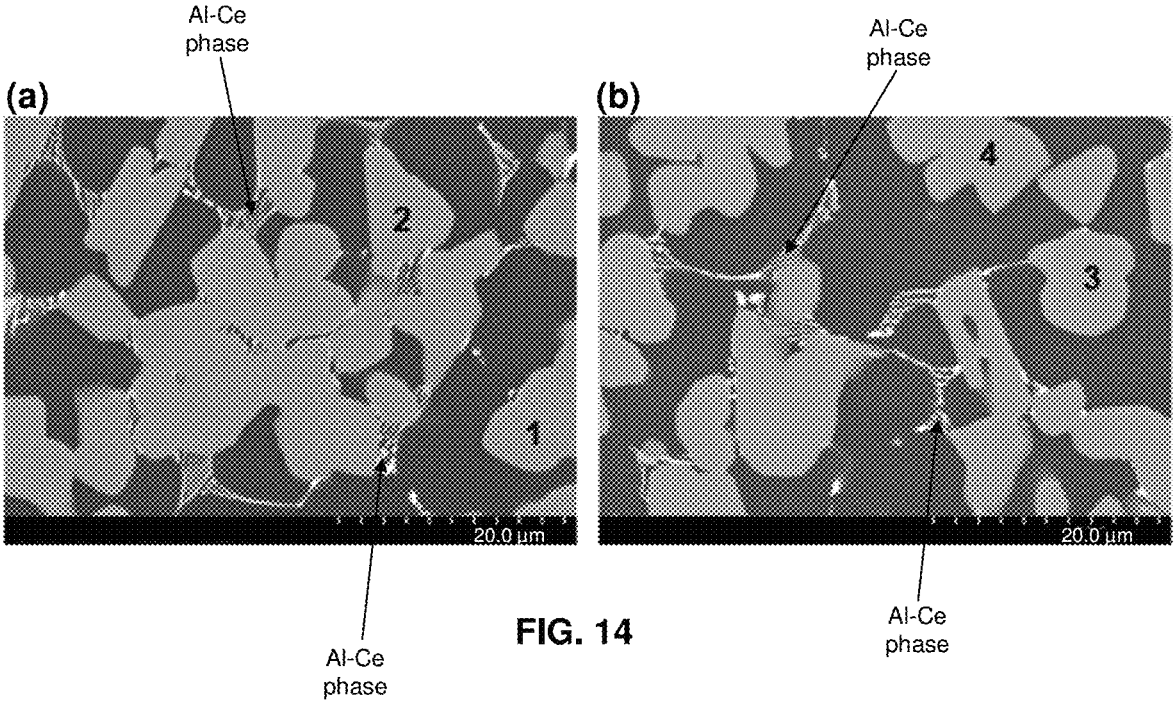
FIG. 14 is a series of micrographs of microstructures of an arc-melted Al-13Ce-8Mn alloy in the center of the sample alloy, according to one embodiment. Parts (a) and (b) represent different fields of regions in the center of the sample alloy.

FIG. 14 is a series of SEM micrographs of regions in the center of an arc-melted Al-13Ce-9Mn alloy. Parts (a) and (b) depict different fields of the regions in the center of the alloy. The phase compositions (in terms of at. %) of the microstructures, e.g., intermetallic particles, numbered 1, 2, 3, and 4 on the images, are listed in Table 5. Each particle 1-4 represents one type of ternary intermetallic phase. A binary Al—Ce phase was detected at the bright white/gray regions (arrow).

TABLE 5

Phase Composition of Microstructures at the center of Al—13Ce—Mn Alloy

| Element | 1 | 2 | 3 | 4 |
|---|---|---|---|---|
| Al | 85.16 | 85.43 | 85.66 | 85.49 |
| Mn | 10.4 | 10.07 | 9.76 | 9.94 |
| Ce | 4.44 | 4.5 | 4.58 | 4.47 |

Figure 15:
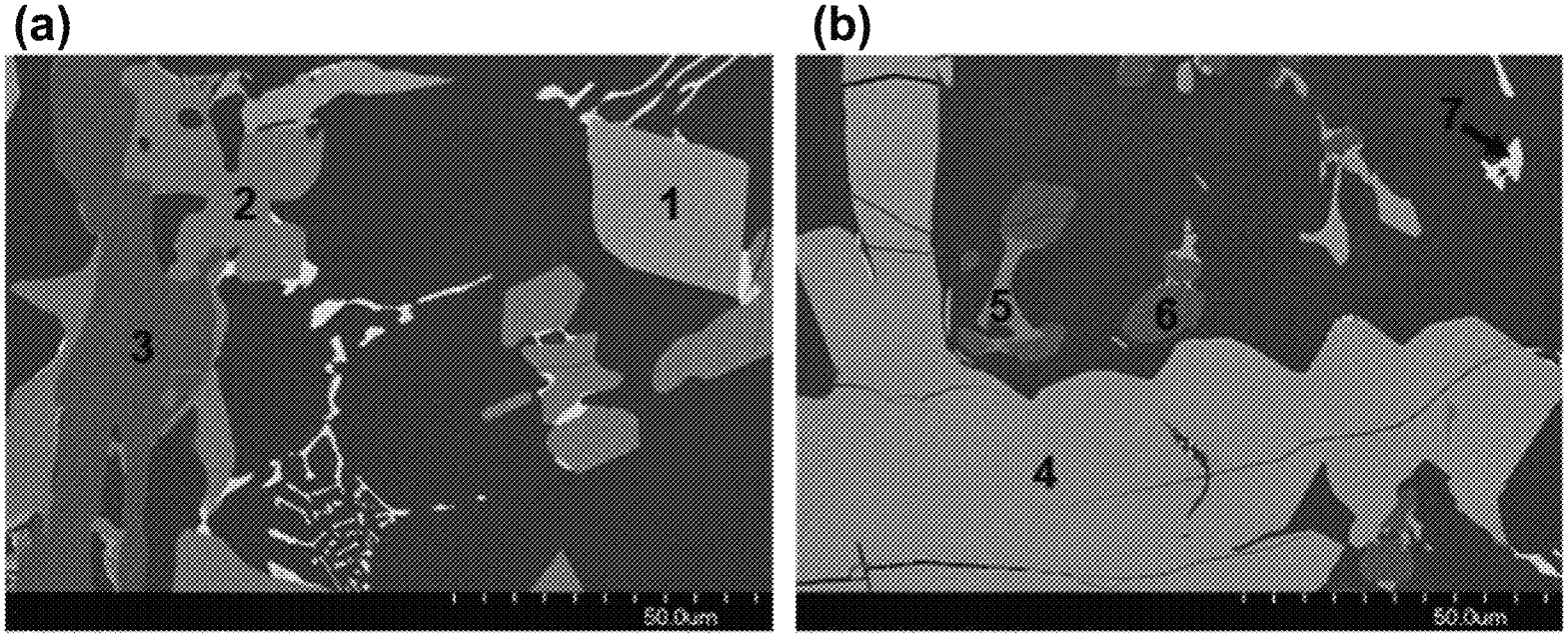
FIG. 15 is a series of micrographs of microstructures of conventionally cast Al-13Ce-8Mn alloy, according to one embodiment. Parts (a) and (b) represent different fields of a region of the conventionally cast alloy.

FIG. 15 is a series of SEM micrographs of regions of a conventionally cast Al-13Ce-8Mn alloy. The phase compositions (in terms of at. %) of the regions numbered 1, 2, 3, 4, 5, 6, and 7 on the images are listed in Table 6. Two ternary intermetallic phases such that regions 1 and 4 have the same composition representing one type of ternary intermetallic phase and regions 2 and 5 having the same composition representing a second type of ternary

TABLE 6

Phase Composition of Microstructures of Conventionally Cast Al-13Ce-8Mn.

| Element | 1 | 2 | 3 | 4 | 5 | 6 | 7 |
|---|---|---|---|---|---|---|---|
| Al | 77.18 | 87.12 | 85.76 | 76.5 | 87.22 | 85.36 | 83.75 |
| Mn | 14.95 | 8.17 | 14.24 | 15.56 | 8.43 | 14.64 | N/A |
| Ce | 7.86 | 4.71 | N/A | 7.94 | 4.35 | N/A | 16.25 |

intermetallic phase. A binary Al—Ce phase was detected by regions 3 and 6 and region 7 is an Al—Ce binary phase.

Figure 16:
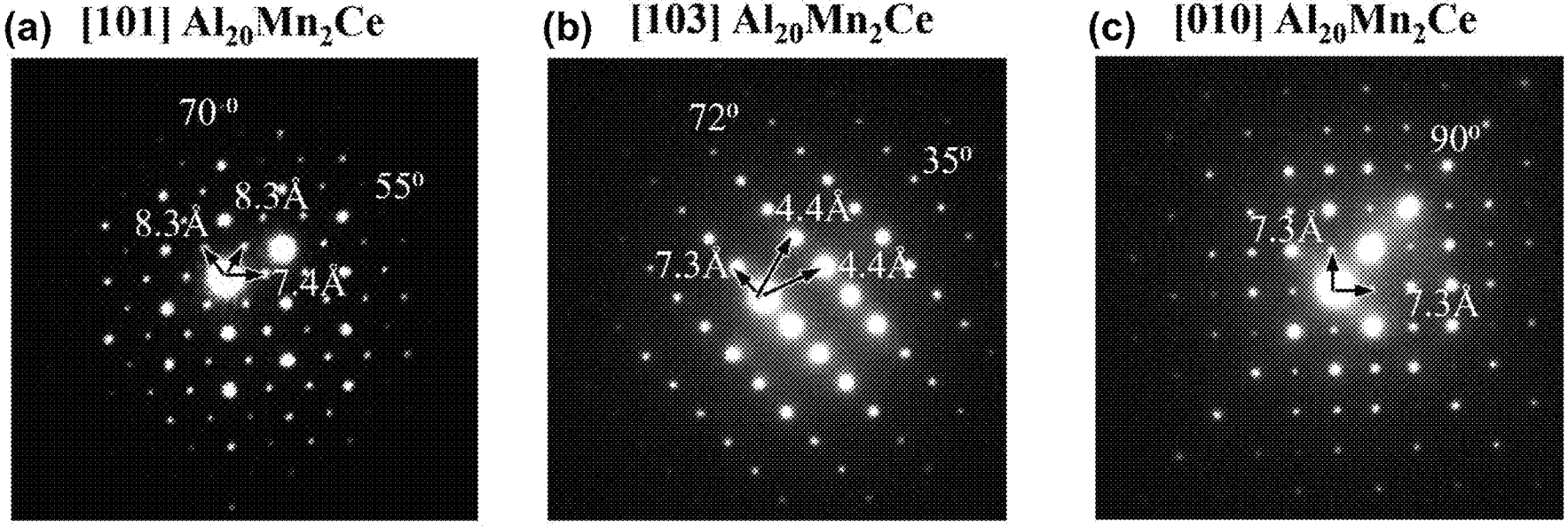
FIG. 16 is a series of images by transmission electron microscopy (TEM) of the diffraction of $Al_{20}Mn_2Ce$ phase in arc-melted Al-13Ce-8Mn alloy, according to one embodiment. Parts (a), (b), and (c) represent different zone axes for structure confirmation.

FIG. 16 depicts the diffraction of $Al_{20}Mn_2Ce$ in arc melted Al-13Ce-8Mn alloy by transmission electron microscopy (TEM) selected area diffraction. Parts (a), (b), and (c) represent different zone axes for structure confirmation. Simulated patterns of the phase confirmed that the predicted zone matched the actual (data not shown).

In Use

According to various embodiments described herein, optimized compositions of Al-RE alloys as determined by adding an RE element to conventional alloys (A356, A390, and A206 alloys, Al—Mg, Al—Si and Al—Cu alloys, etc.) may be used to improve production of complex near-net-shape and net-shape parts. The embodiments also describe how to modify composition to accommodate for the formation of Al—Ce—X compounds during solidification and/or their evolution during heat treatment, that changes the strengthening potency of common Al alloying elements in the presence of Ce and other RE elements. Current uses of optimized compositions of Al—Ce alloys include casting tests, additive manufacturing processes, advanced manufacturing process, etc. In some approaches, optimized compositions of Al-RE alloys may be used in aluminum casting, extrusion, forging, 3D printing, etc. of high-strength and high-temperature materials.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments but should be defined only in accordance with the following claims and their equivalents.

What is claimed is:

1. An alloy, comprising:

aluminum;

a rare earth element; and an alloying element selected from the group consisting of: Si, Cu, Mg, Fe, Ti, Zn, Zr, Mn, Ni, Sr, B, Ca, and a combination thereof, wherein the aluminum (Al), the rare earth element (RE), and the alloying element are characterized by forming at least one form of an intermetallic compound, wherein an amount of the rare earth element in the alloy is in a range of about 1 wt. % to about 12 wt. %, wherein an amount of the alloying element in the alloy is greater than an amount of the alloying element present in the intermetallic compound, wherein the amount of alloying element present in the intermetallic compound is a portion of the amount of alloying element in the alloy.

2. The alloy as recited in claim 1, comprising an Al-based matrix, wherein the alloying element is present in the Al-based matrix.

3. The alloy as recited in claim 1, wherein the alloy includes more than one composition of the intermetallic compound, wherein each composition of the intermetallic compound has a different crystal structure.

4. The alloy as recited in claim 1, wherein the rare earth element is selected from the group consisting of: Ce, La, Nd, Pr, and mischmetal.

5. The alloy as recited in claim 1, wherein the alloying element is a combination of a first alloying element and at least one second alloying element that is different from the first alloying element, wherein the at least one form of the intermetallic compound comprises Al-RE-the first alloying element.

6. The alloy as recited in claim 5, wherein the second alloying element has partial occupancy within the intermetallic compound Al-RE-the first alloying element.

7. The alloy as recited in claim 1, wherein the alloying element includes Si, wherein the alloy is characterized as having:

a ratio of amounts of Si:RE greater than 2:1, ternary intermetallic compound Al—RE-Si, Si having an elemental form, and an Al-based matrix.

8. The alloy as recited in claim 7, wherein the ternary intermetallic compound Al—RE-Si is selected from the group consisting of: $RE(Si_{1-x},Al_x)_2$, $AlRESi_2$, $AlxRESi_{2-x}$, $Al_2RESi_2$, and $Al_4RE_3Si_6$.

9. The alloy as recited in claim 1, wherein the alloying element includes Cu, wherein the alloy is characterized as having:

a ratio of amounts of Cu:RE greater than 1.5:1, a ternary intermetallic compound Al—RE-Cu, and an Al-based matrix comprising Cu.

10. The alloy as recited in claim 9, wherein the ternary intermetallic compound Al—RE-Cu is selected from the group consisting of: $Al_8RECu_4$, $Al_{10}RE_2Cu_7$, $Al_3RECu$, AlRECu, and $AlRE_2Cu_2$.

11. The alloy as recited in claim 1, wherein the alloying element include Mg, wherein the alloy is characterized as having:

a ratio of amounts of Mg:RE is greater than 1:1 a ternary intermetallic compound Al—RE-Mg, and an Al-based matrix comprising Mg.

12. The alloy as recited in claim 1, wherein the alloying element includes Ni, wherein the alloy is characterized as having:

a ratio of amounts of Ni:RE greater than 0.8:1, a ternary intermetallic compound Al—RE-Ni, and an Al-based matrix comprising Ni.

13. The alloy as recited in claim 12, wherein the ternary intermetallic compound Al—RE-Ni is selected from the group consisting of: Al—RE-Ni: AlRENi, $Al_2RENi$, $Al_{23}RE_4Ni_6$, $Al_5RENi_2$, $Al_4RENi$, $Al_5RE_2Ni_5$, $Al_3RENi_2$, $Al_7RENi_2$, $Al_{17}RE_{40}Ni_{43}$, and $AlRENi_4$.

14. The alloy as recited in claim 1, wherein the alloying element includes Mn, wherein the alloy is characterized as having:

a ratio of amounts of Mn:RE greater than 0.8:1, a ternary intermetallic compound Al—RE-Mn, and an Al-based matrix comprising Mn.

15. The alloy as recited in claim 1, wherein the alloying element include Fe, wherein the alloy is characterized as having:

a ratio of amounts of Fe:RE greater than 0.8:1, a ternary intermetallic compound Al—RE-Fe, and an Al-based matrix comprising Fe.

16. The alloy as recited in claim 15, wherein the ternary intermetallic compound Al—RE-Fe is selected from the group consisting of: $Al_{10}REFe_2$, $Al_8REFe_2$, and $AL_8REFe_4$.

17. The alloy as recited in claim 1, wherein the alloying element includes Zn, wherein the alloy is characterized as having:

a ratio of amounts of Zn:RE greater than 1:1, a ternary intermetallic compound Al—RE-Zn, and an Al-based matrix comprising Zn.

18. The alloy as recited in claim 1, wherein the alloy has a structure comprising:

a plurality of particles; and an Al-based matrix positioned around the particles, wherein each particles comprises a core having a first intermetallic compound, and a shell surrounding the core, wherein the shell has a second intermetallic compound that is different from the first intermetallic compound.

19. The alloy as recited in claim 18, wherein the core includes the aluminum and the rare earth element, the shell includes the at least one form of a ternary intermetallic compound comprising the aluminum, the rare earth element, and the alloying element, and the Al-based matrix includes the alloying element.

20. A composite material comprising the alloy as recited in claim 1 and an additional material, wherein an amount of the alloy is in a range of about 50 vol. % to about 99.9 vol. % of a total vol. % of the composite material.

* * * * *